US010392772B2

(12) United States Patent
Lee

(10) Patent No.: US 10,392,772 B2
(45) Date of Patent: Aug. 27, 2019

(54) CONSTRUCTION METHOD FOR BAND TYPE FIBER REINFORCING MATERIAL FOR REINFORCED-SOIL RETAINING-WALL

(71) Applicant: HANFORCE, CO., LTD, Gyeonggi-do (KR)

(72) Inventor: Jeung Su Lee, Gyeonggi-do (KR)

(73) Assignee: HANFORCE CO., LTD., Gyeonggi-Do (KR)

( * ) Notice: Subject to any disclaimer, the term of this patent is extended or adjusted under 35 U.S.C. 154(b) by 0 days.

(21) Appl. No.: 15/521,711

(22) PCT Filed: Mar. 12, 2015

(86) PCT No.: PCT/KR2015/002386

§ 371 (c)(1),
(2) Date: Apr. 25, 2017

(87) PCT Pub. No.: WO2016/093432

PCT Pub. Date: Jun. 16, 2016

(65) Prior Publication Data

US 2018/0044878 A1 Feb. 15, 2018

(30) Foreign Application Priority Data

Dec. 11, 2014 (KR) ..... 10-2014-0178293
Jan. 9, 2015 (KR) ..... 10-2015-0003151
(Continued)

(51) Int. Cl.
*E02D 29/02* (2006.01)
*E02D 17/20* (2006.01)

(52) U.S. Cl.
CPC ..... *E02D 29/0233* (2013.01); *E02D 17/20* (2013.01); *E02D 29/02* (2013.01); *E02D 29/0266* (2013.01)

(58) Field of Classification Search
CPC . E02D 29/02; E02D 29/0225; E02D 29/0233; E02D 29/0241; E02D 29/0266
See application file for complete search history.

(56) References Cited

U.S. PATENT DOCUMENTS

2007/0003381 A1* 1/2007 Lee ..... E02D 29/025 405/286

FOREIGN PATENT DOCUMENTS

JP 09-165762 6/1997
JP 2009-167766 7/2009
(Continued)

OTHER PUBLICATIONS

International Search Report for PCT/KR2015/002386 dated Sep. 10, 2015 (4 pages).

*Primary Examiner* — Tara Mayo-Pinnock
(74) *Attorney, Agent, or Firm* — Susan Paik, Esq.

(57) ABSTRACT

The present invention relates to a method of constructing a band type fiber reinforcement material for a reinforced-soil retaining-wall structure which enables quick and easy connection of a band type fiber reinforcing material, provides various connection methods therefor, and prevents stress from being concentrated in a connection part with a facing member during the sinking of a reinforced soil body, including: inserting a band type fiber reinforcement material into reinforcement material insertion members provided in facing members standing at a front of a reinforced soil mass (G) such that the facing members are adjacent to each other in leftward and rightward directions; spreading the band type fiber reinforcement material on the reinforced soil mass and laying and hardening a backfill material on the band type fiber reinforcement material and the reinforced soil mass; and repeatedly carrying out the first step and the second step until a predetermined height is reached.

6 Claims, 18 Drawing Sheets

(30) Foreign Application Priority Data

| | | |
|---|---|---|
| Jan. 30, 2015 | (KR) | 10-2015-0014728 |
| Feb. 11, 2015 | (KR) | 10-2015-0021010 |
| Mar. 6, 2015 | (KR) | 10-2015-0031453 |
| Mar. 11, 2015 | (KR) | 10-2015-0033894 |

(56) References Cited

FOREIGN PATENT DOCUMENTS

| | | |
|---|---|---|
| KR | 10-0615472 | 8/2006 |
| KR | 10-0722963 | 5/2007 |
| KR | 20-0453027 | 3/2011 |
| KR | 10-2014-0134150 | 11/2014 |

* cited by examiner

[Fig. 1]
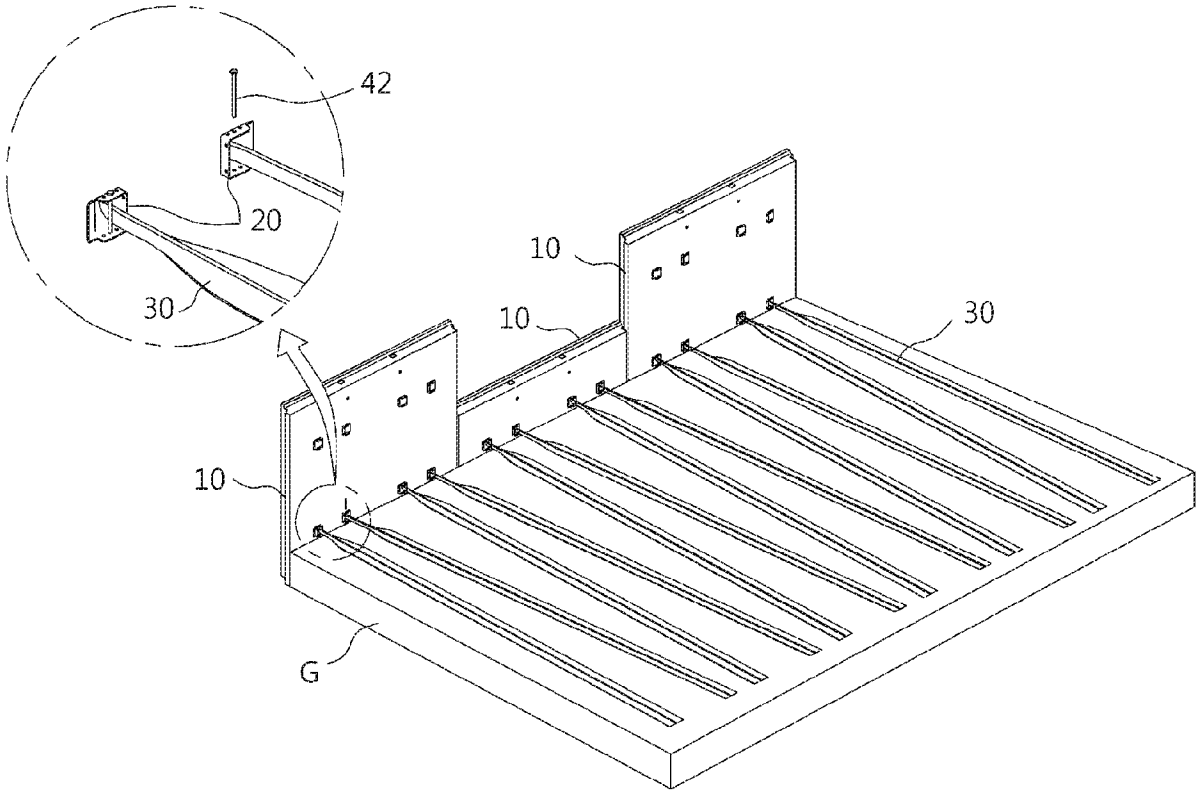

[Fig. 2]
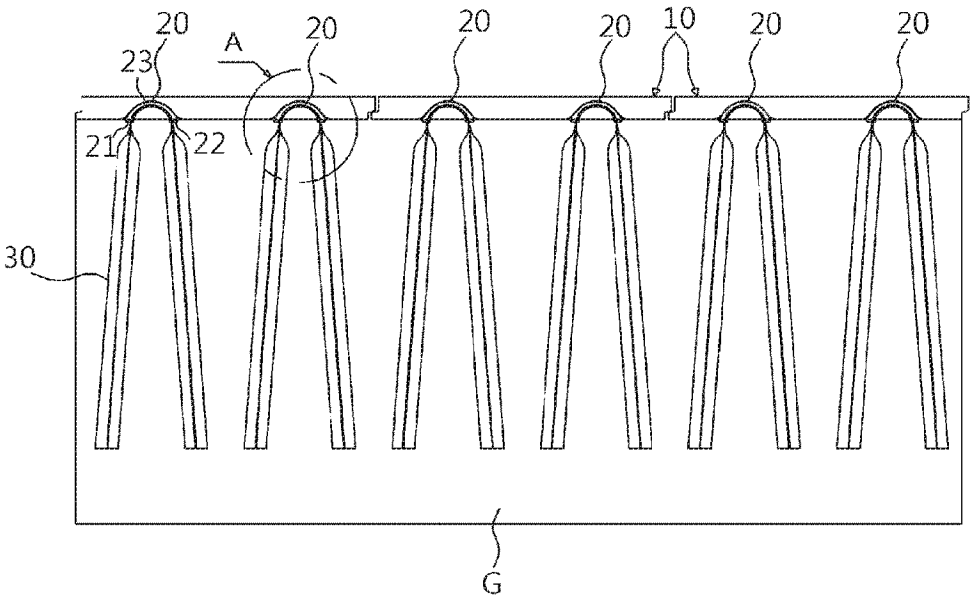
[Fig. 3]
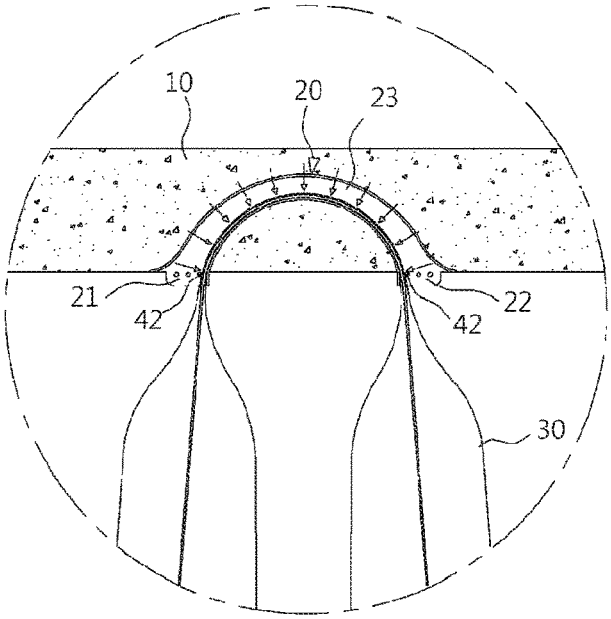

[Fig. 4]
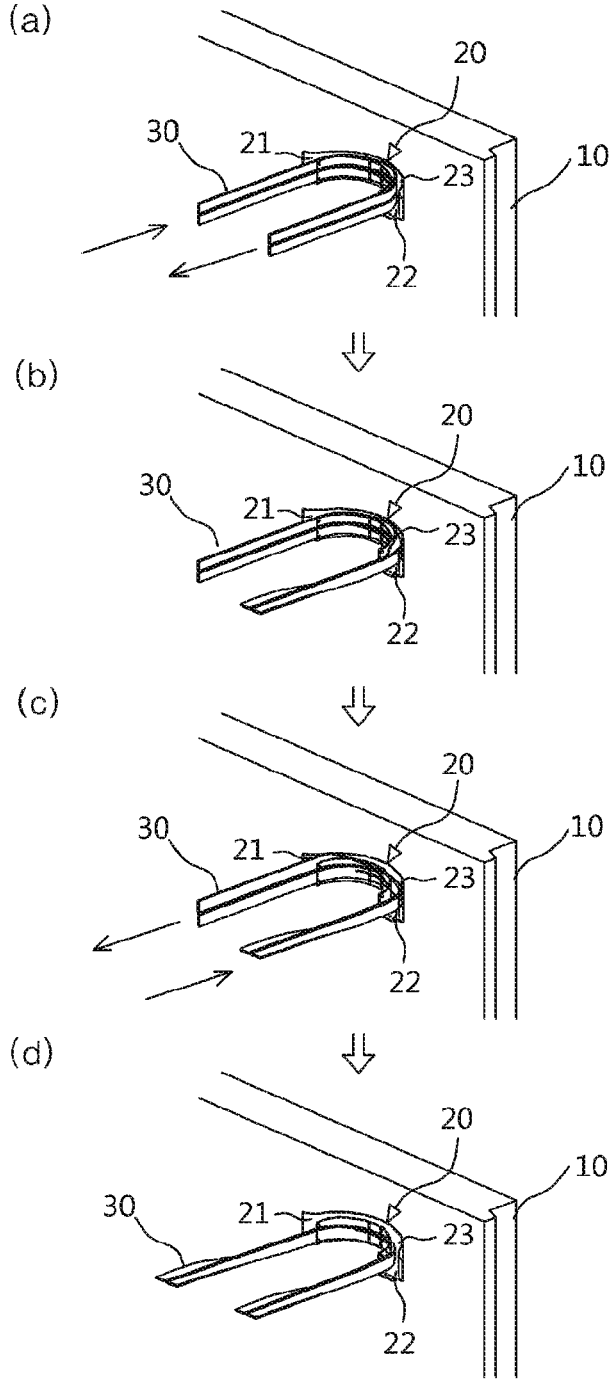

[Fig. 5]
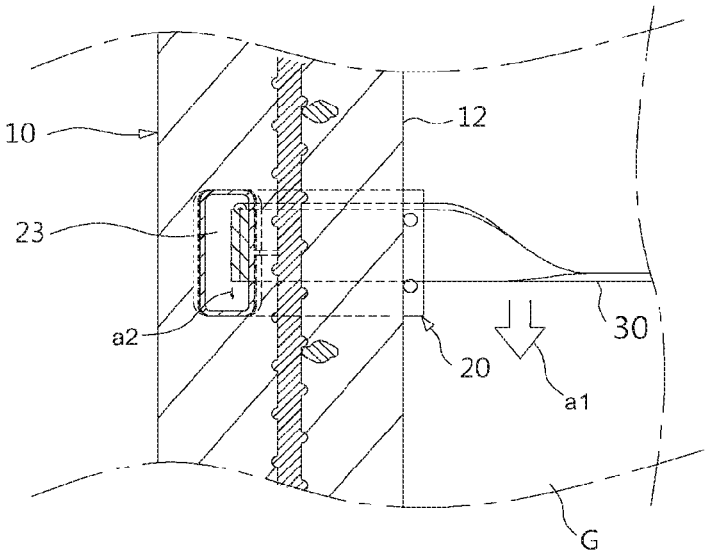

[Fig. 6]
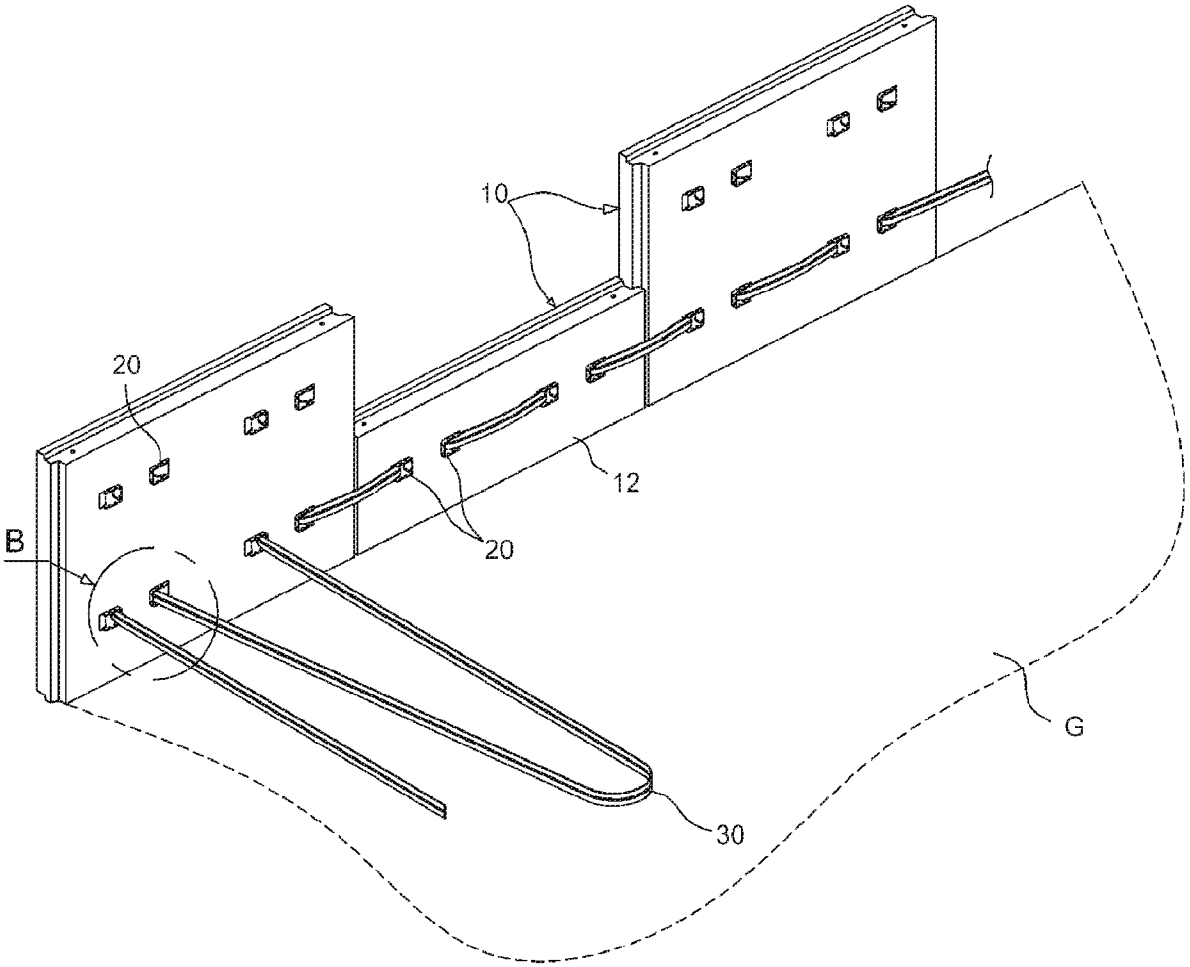

[Fig. 7]
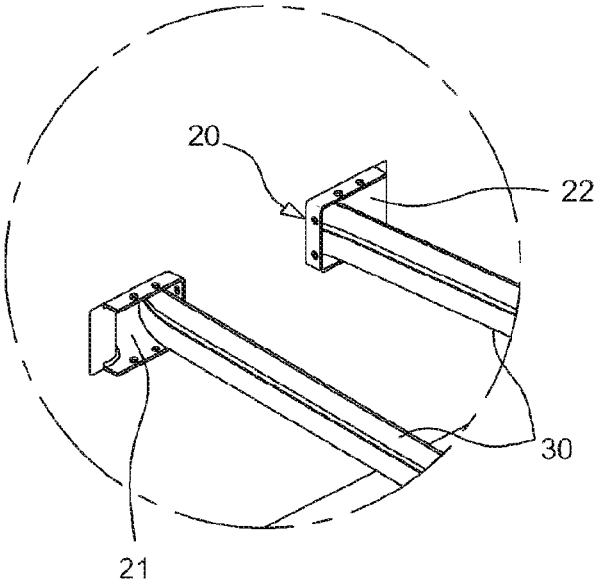

[Fig. 8]
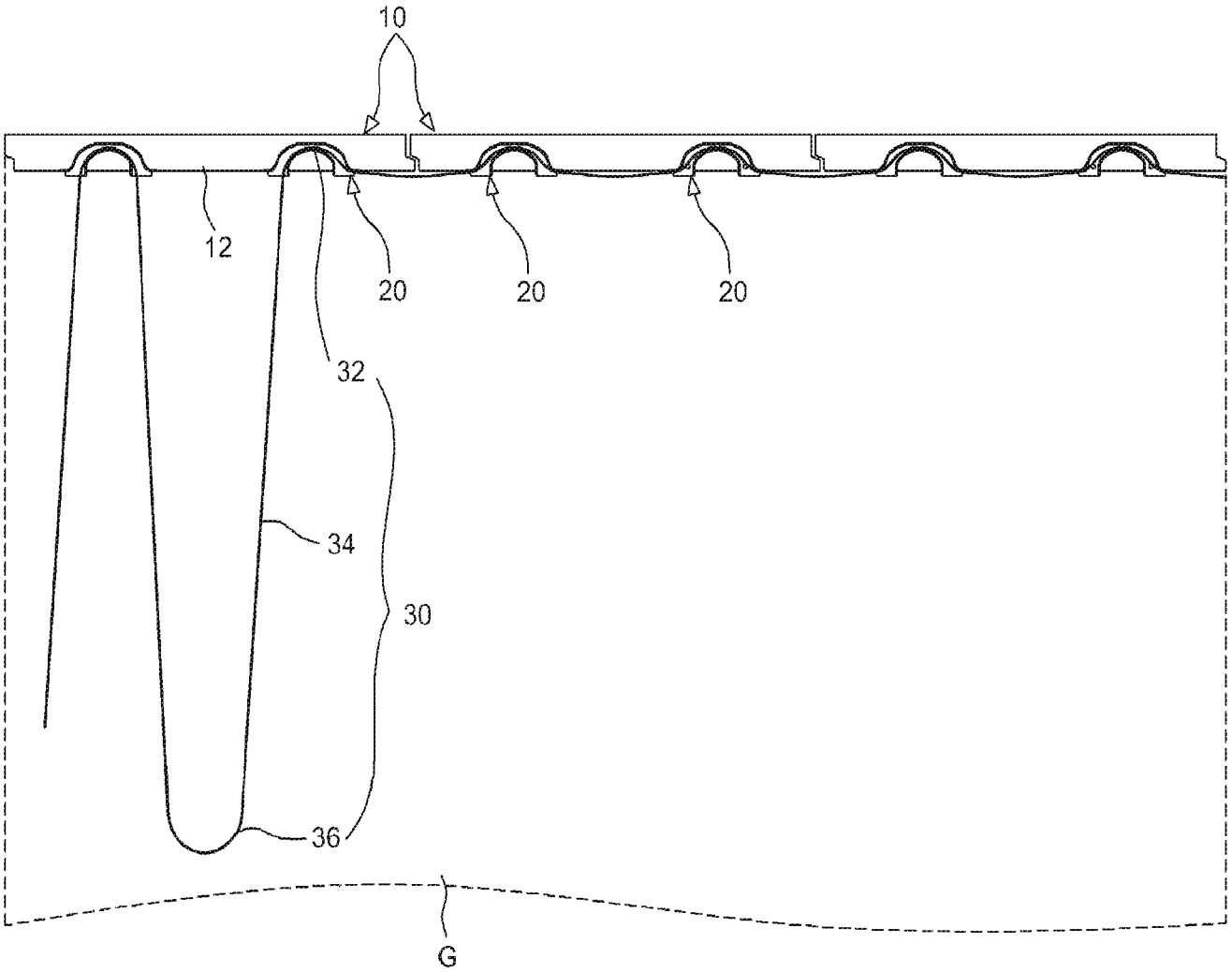

[Fig. 9]
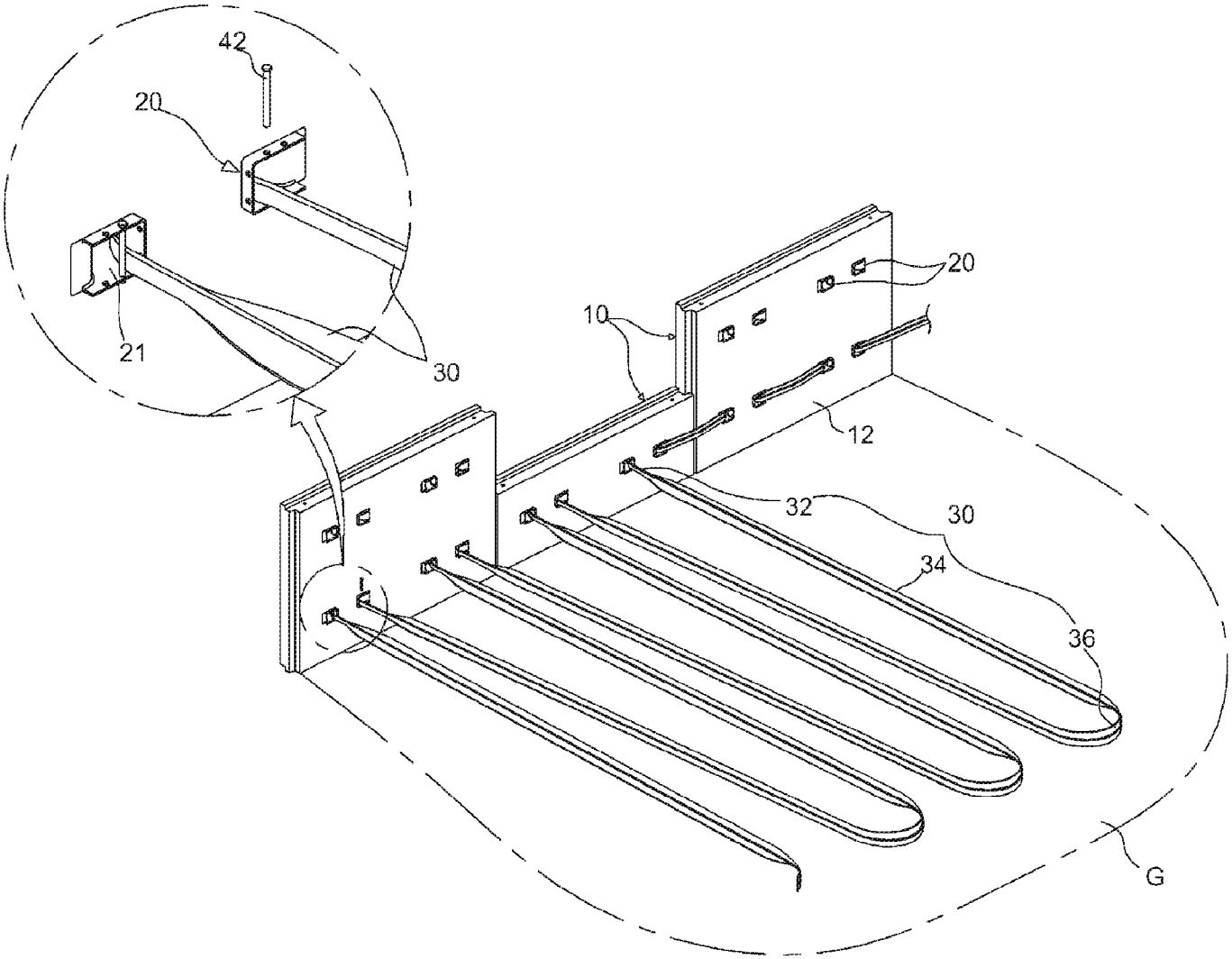

[Fig. 10]
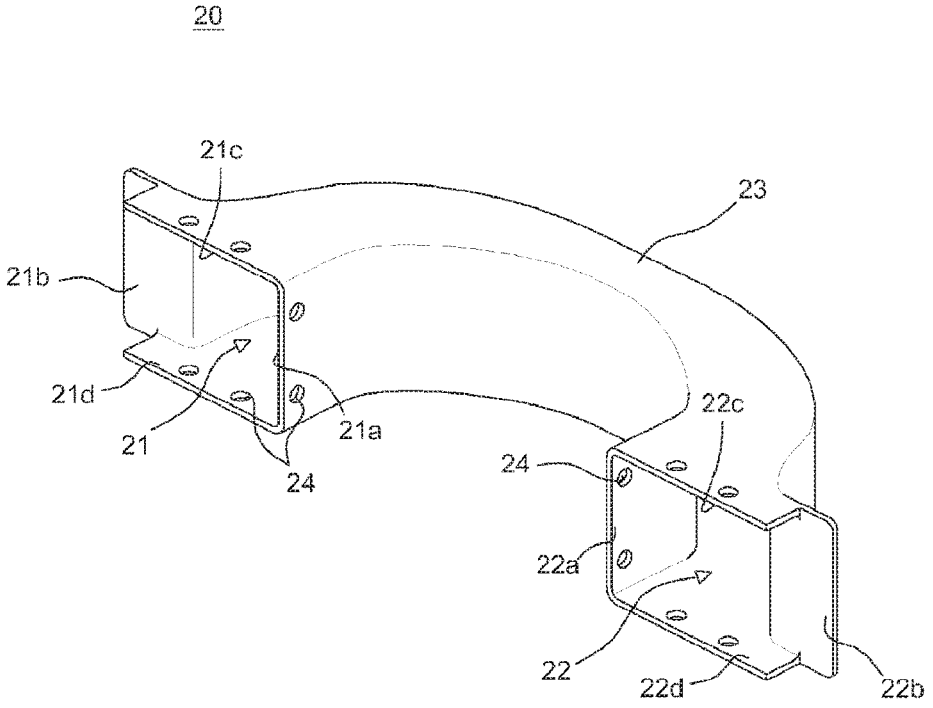
[Fig. 11]
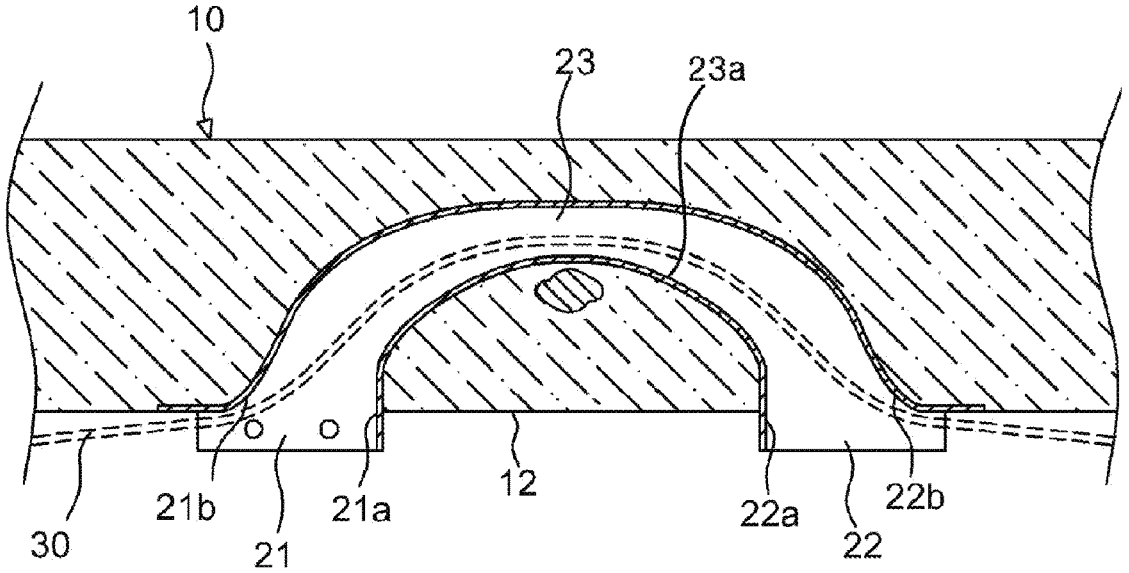

[Fig. 12]
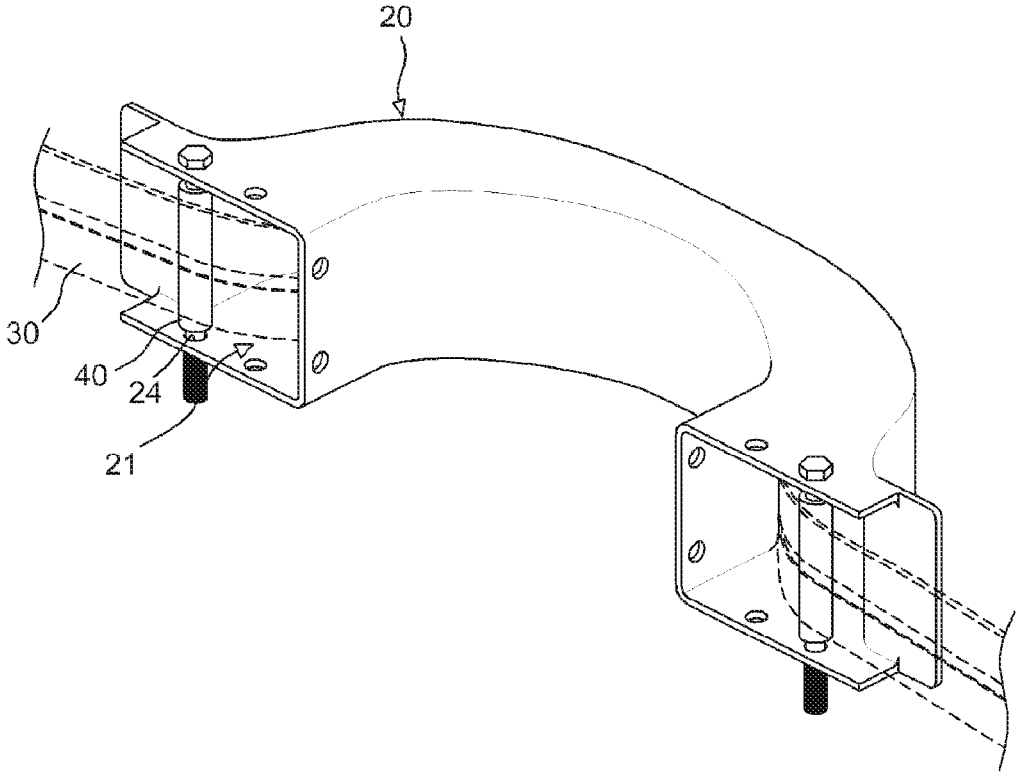

[Fig. 13]
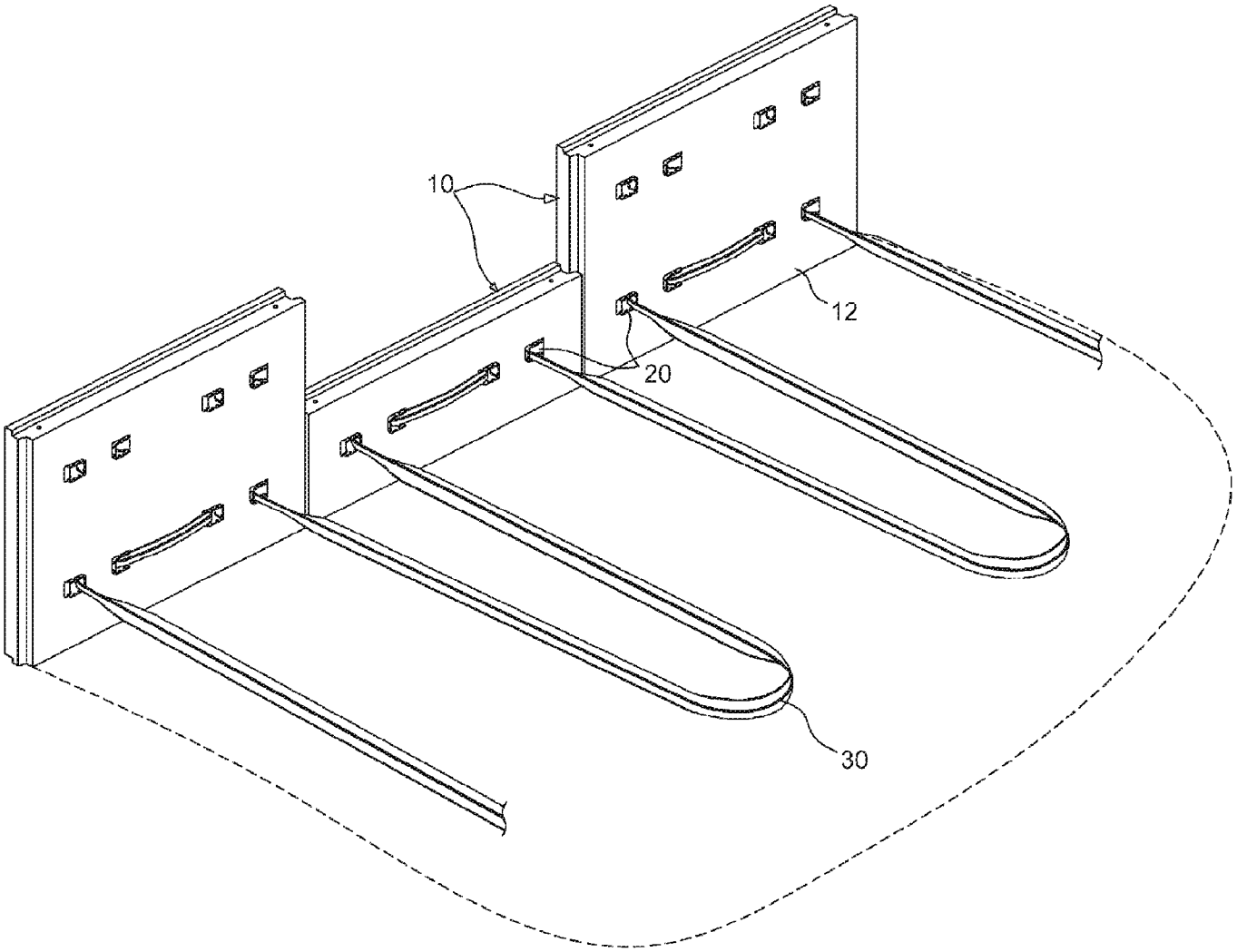

[Fig. 14]
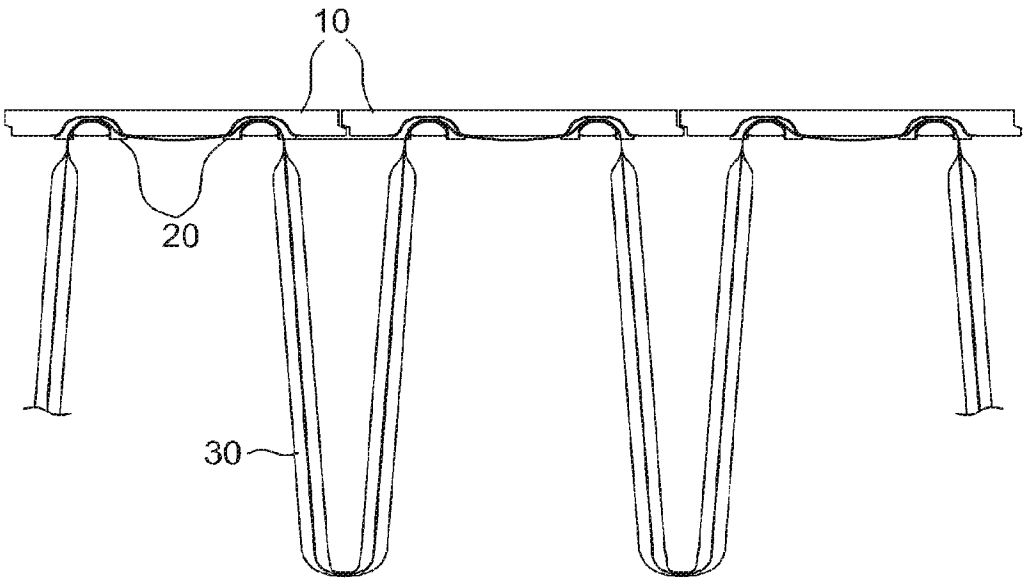

[Fig. 15]
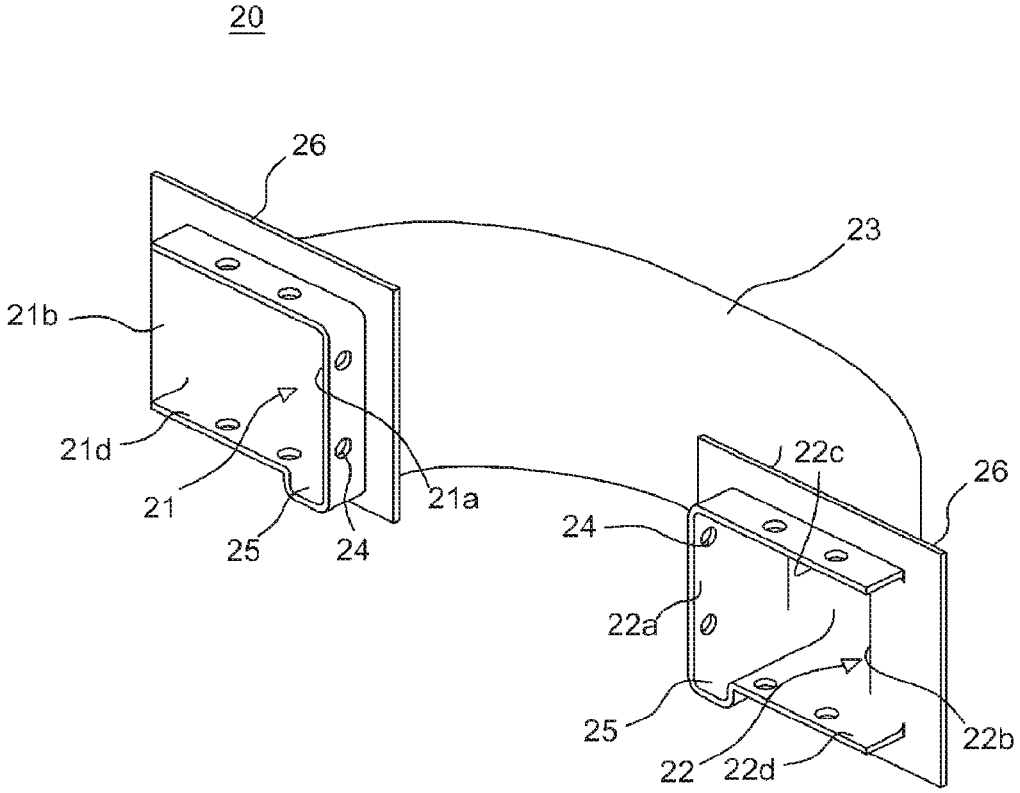

[Fig. 16]
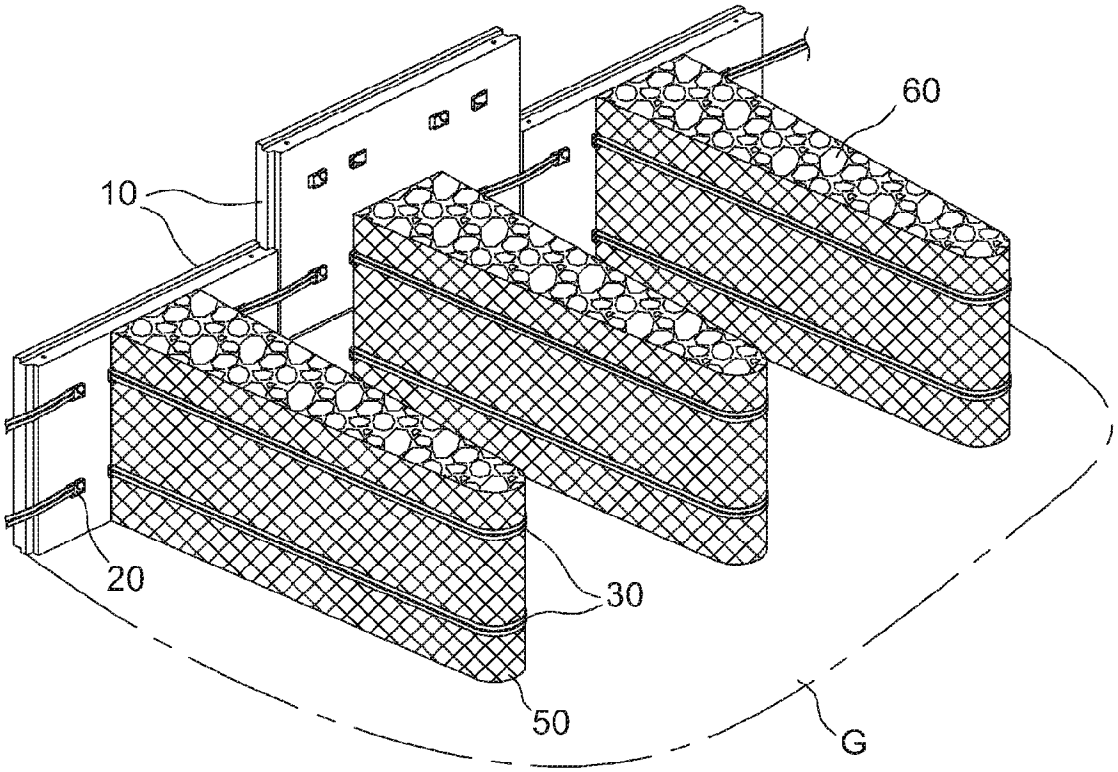

[Fig. 17]
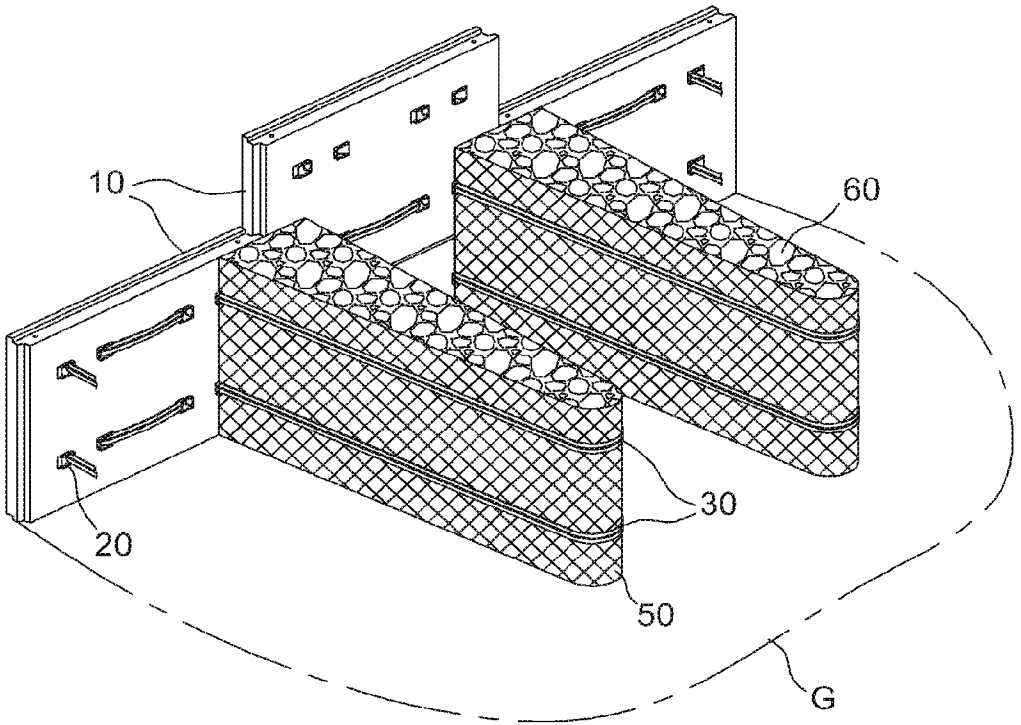

[Fig. 18]
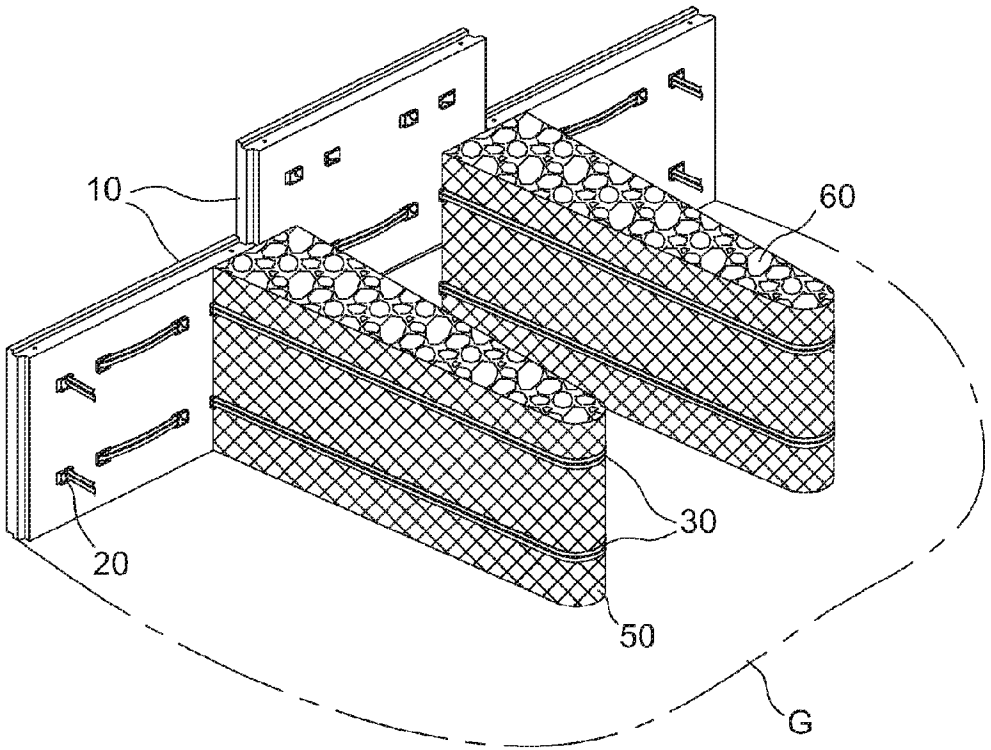

[Fig. 19]
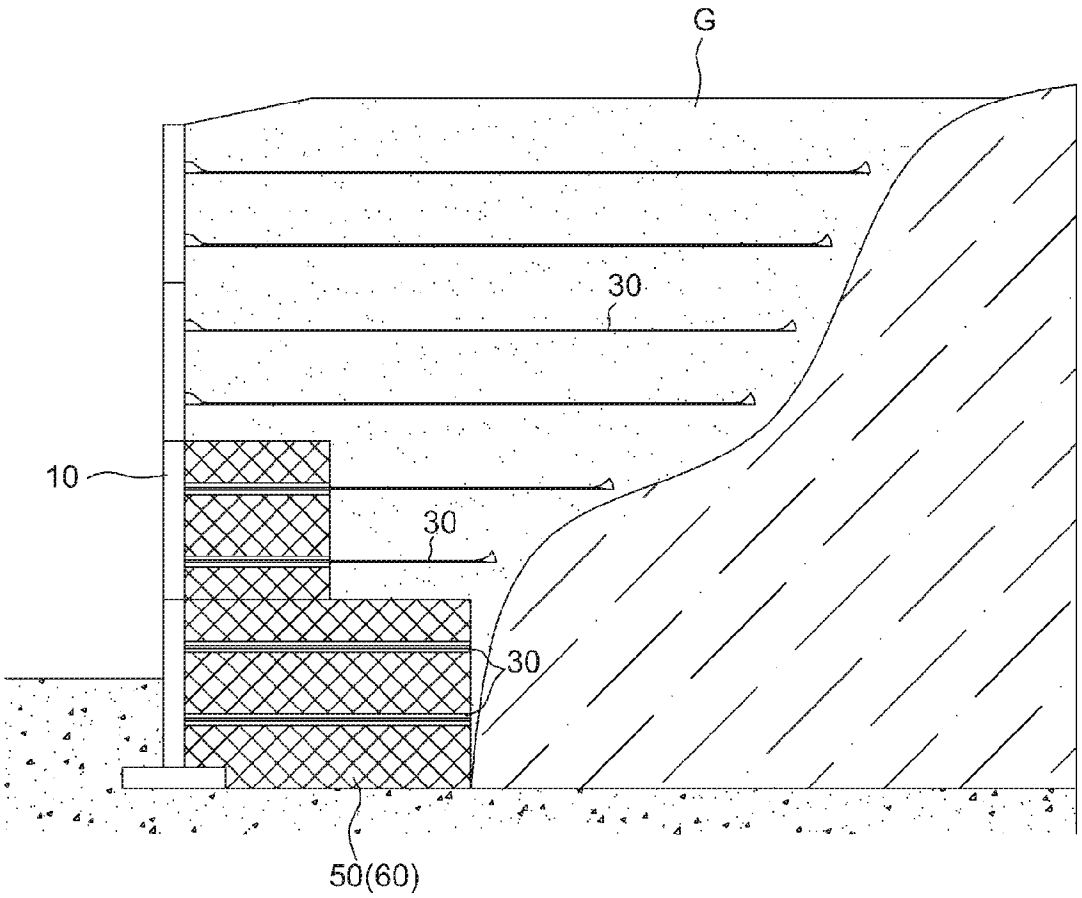

[Fig. 20]
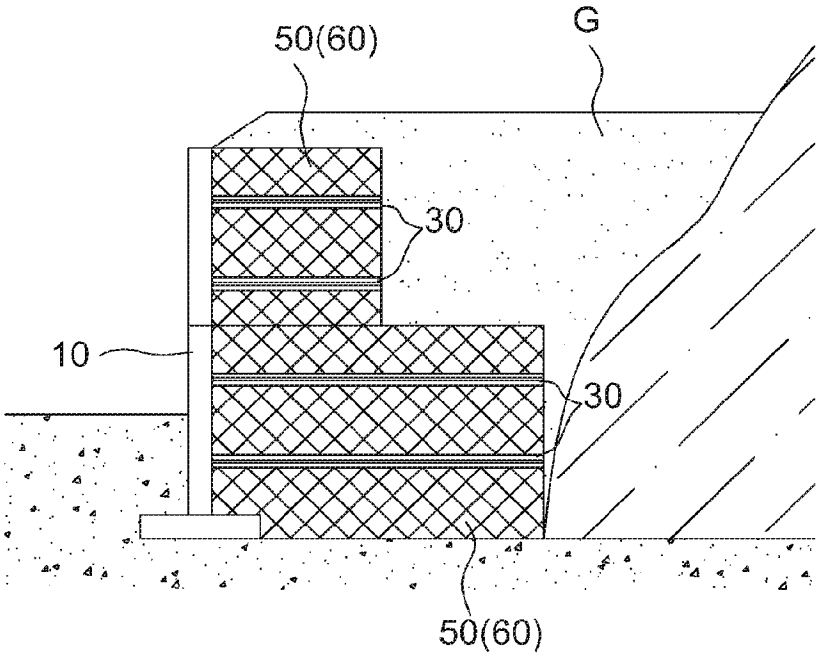

CONSTRUCTION METHOD FOR BAND TYPE FIBER REINFORCING MATERIAL FOR REINFORCED-SOIL RETAINING-WALL

TECHNICAL FIELD

The present invention relates to a method of constructing a band type fiber reinforcement material for the reinforced soil retaining wall, wherein the band type fiber reinforcement material is rapidly and easily connected to the facing member, in which a reinforcement material insertion member is provided, thereby improving workability and constructability, wherein a connection mode (i.e. a connection form) in which the band type fiber reinforcement material is connected to the facing member is changed variously depending on site conditions or on the situation, and wherein shear stress is prevented from being concentrated on the connection between the band type fiber reinforcement material and the facing member when a reinforced soil mass sinks, whereby it is possible to construct a reinforced soil retaining wall structure that exhibits high stability.

BACKGROUND ART

In general, a reinforced soil retaining wall includes a reinforced soil mass, in which a strip-shaped reinforcement material is buried, and a retaining wall, i.e. a facing member, stood at the front of the reinforced soil mass. The front end of the reinforcement material, which is buried in the reinforced soil mass (i.e. a filling mass), is connected to the facing member via an anchor pin, or is inserted into a reinforcement material insertion groove formed in the upper surface of the facing member.

In addition, in the reinforced soil retaining wall, a mesh type grid, a band type fiber reinforcement material, or a steel strip reinforcement material is used as the reinforcement material. In the present invention, a band type fiber reinforcement material is used as the reinforcement material. Hereinafter, a reinforced soil retaining wall using a band type fiber reinforcement material will be described.

A conventional retaining wall construction block is disclosed in Patent Document 1, wherein a pin holder is installed in the rear surface of a block in a buried state such that it is possible to prevent the separation of connection pins at the time of pulling a reinforcement material and to rapidly and easily perform a reinforcement material connection operation, instead of using an exposure type anchoring method. The pin holder is provided with a reinforcement material insertion part, through which a band type fiber reinforcement material is inserted into the block. Connection pin insertion parts are formed at the left and right sides of the upper part of the reinforcement material insertion part in a symmetrical fashion such that the connection pins are inserted into the block through the connection pin insertion parts. The connection pin insertion parts are successively formed in the inner lower end of the reinforcement material insertion part in an arc shape. Catching parts, in which the left and right sides of the connection pins inserted into the block are caught, are formed in the lower ends of the connection pin insertion parts, whereby the reinforcement material is anchored by the connection pins in the block. However, the invention of this patent document has a problem in that subsidiary materials, such as connection pins, are needed.

In addition, as disclosed in Patent Document 2, a stabilized soil structure includes a main body, made of a cast material, configured to be securely connected to the interior of a sheathing element (e.g. a wall body) in the state in which the front end of a strip is prevented from being abruptly bent or twisted without using additional connection pins, wherein a channel for a reinforcement strip is formed in the main body between two protruding points located at the rear surface of the sheathing element, and the channel includes two straight parts respectively adjacent to the two protruding points and disposed such that the strip is located in the same protruding plane, which is perpendicular to the rear surface, two curved parts respectively connected to the two straight parts and disposed such that the strip escapes from the protruding plane, and a connection part for interconnecting the two curved parts, the connection part having at least one loop located outside the protruding plane.

In Patent Document 2, the reinforcement strip can be connected to the sheathing element without being twisted or abruptly bent. In order to connect the reinforcement strip to the sheathing element, however, an additional subsidiary member, such as a wire, is needed, and it takes a lot of time and effort to connect the reinforcement strip to the sheathing element, whereby constructability is lowered. In addition, it is difficult to successively construct the reinforcement strip in a serpentine fashion without cutting the reinforcement strip. For this reason, a cut portion of the reinforcement strip having a predetermined length must be individually connected to each connection region, whereby workability and constructability are lowered.

In addition, in Patent Document 2, the reinforcement strip depends merely on frictional resistance, with the result that the length of the reinforcement strip that must be laid is increased, which is uneconomical. Furthermore, the cut edge of the reinforcement strip contacts moisture, salt, and other chemical components in soil, with the result that the physical properties of the reinforcement strip may be changed. In this case, the stability of the soil structure may be affected.

RELATED ART DOCUMENT

Patent Documents

Korean Registered Utility Model No. 20-0453027 (registered on Mar. 25, 2011) entitled *Retaining wall construction block capable of enabling band type fiber reinforcement material to be easily connected thereto*

Korean Registered Patent No. 10-0722963 (registered on May 22, 2007) entitled *Stabilized soil structure and sheathing element for constructing the soil structure*

SUMMARY OF THE INVENTION

Technical Problem

The present invention has been made in view of the above problems, and it is an object of the present invention to provide a method of constructing a band type fiber reinforcement material for the reinforced soil retaining wall, wherein a band type fiber reinforcement material can rapidly and easily be connected to various kinds of facing members, including a panel type facing member or a block type facing member, without using an additional connection member, no additional pulling operation is needed, a connection mode (i.e. a connection form) in which the front end of the band type fiber reinforcement material is connected to the facing member and the band type fiber reinforcement material is laid on a filling mass can be changed variously, length that the band type fiber reinforcement material is laid can be reduced, shear stress can be prevented from being concentrated on the front end of the band type fiber reinforcement material at the connection between the band type fiber reinforcement material and the facing member when a reinforced soil mass sinks after the reinforced soil retaining wall structure is constructed, and swelling or twisting of the facing member can also be prevented, whereby it is possible to construct a reinforced soil retaining wall structure that exhibits high stability.

Technical Solution

In order to accomplish the above object, the present invention provides a method of constructing a band type fiber reinforcement material for a reinforced soil retaining wall, the method including a first step of inserting a band type fiber reinforcement material into reinforcement material insertion members provided in facing members standing at a front of a reinforced soil mass such that the facing members are adjacent to each other in leftward and rightward directions;

a second step of spreading the band type fiber reinforcement material on the reinforced soil mass and laying and hardening a backfill material on the band type fiber reinforcement material and the reinforced soil mass, and a third step of repeatedly carrying out the first step and the second step until a predetermined height is reached, wherein each of the reinforcement material insertion members includes two entrances, which are open to the rear surface of a corresponding one of the facing members and spaced apart from each other in the leftward and rightward directions, and a through channel formed inside the rear surface of the corresponding one of the facing members between the entrances, and, at the first step, the band type fiber reinforcement material is inserted through one of the entrances and is withdrawn through the other entrance in a state of being spread so as to have a full width, whereby the band type fiber reinforcement material is connected to each of the reinforcement material insertion members, and, a front end of the band type fiber reinforcement material, which is withdrawn outside the entrance of each of the reinforcement material insertion members, is folded in a longitudinal direction, and the front end of the band type fiber reinforcement material, which is folded in the longitudinal direction, is inserted into each of the reinforcement material insertion members, such that the front end of the band type fiber reinforcement material is folded.

In an embodiment of the present invention, at the first step, the band type fiber reinforcement material is successively inserted into the reinforcement material insertion members, which are adjacent to each other in the leftward and rightward directions, and at the second step, the band type fiber reinforcement material is pulled from each of the reinforcement material insertion members in a rearward direction such that the band type fiber reinforcement material is laid on the reinforced soil mass in a serpentine fashion, a middle part of the band type fiber reinforcement material, which is laid on the reinforced soil mass, is disposed on the reinforced soil mass in a state of being spread so as to have a full width, and a rear end of the band type fiber reinforcement material is disposed in a loop shape.

In the above embodiment, the band type fiber reinforcement material may be inserted into the reinforcement material insertion members in the state of being spread so as to have a full width or in the state of first being folded in the longitudinal direction. Preferably, the band type fiber reinforcement material is inserted into each of the reinforcement material insertion members in the state of being spread so as to have a full width, the front end of the band type fiber reinforcement material, which is withdrawn outside one of the entrances of each of the reinforcement material insertion members, is folded in the longitudinal direction, for example, so as to have a half width, the front end of the band type fiber reinforcement material, which is folded in the longitudinal direction, is inserted into each of the reinforcement material insertion members, the front end of the band type fiber reinforcement material is folded in the longitudinal direction such that the front end of the band type fiber reinforcement material is folded inside each of the reinforcement material insertion members in the longitudinal direction, and the front end of the band type fiber reinforcement material is brought into tight contact with each of the reinforcement material insertion members.

In another embodiment of the present invention, at the first step, the front end of the band type fiber reinforcement material, which is withdrawn outside one of the entrances of each of the reinforcement material insertion members, is folded in the longitudinal direction, and the front end of the band type fiber reinforcement material, which is folded in the longitudinal direction, is inserted again into each of the reinforcement material insertion members such that the front end of the band type fiber reinforcement materials is in tight contact with the inner surface of each of the reinforcement material insertion members. Here, the band type fiber reinforcement material may be cut to a predetermined length in consideration of the laying length thereof, the cut band type fiber reinforcement materials may be individually connected to the respective reinforcement material insertion members, opposite ends of the band type fiber reinforcement materials connected to the reinforcement material insertion members are laid down on the reinforced soil mass so as to be spread toward the rear of the reinforced soil mass, and a backfill material may be laid and hardened.

Advantageous Effects

In a method of constructing a band type fiber reinforcement material for the reinforced soil retaining wall according to embodiments of the present invention, the band type fiber reinforcement material may be rapidly and easily connected to the facing member without using additional members or assistant tools, whereby it is possible to improve workability and to reduce the construction time. In the state in which the band type fiber reinforcement material is individually connected to each reinforcement material insertion member or is successively inserted into reinforcement material insertion members in advance, the band type fiber reinforcement material may be laid over a backfill material in a serpentine fashion, or may be withdrawn to the rear of the backfill material at predetermined intervals and may then be laid on the backfill material, whereby the band type fiber reinforcement material may be variously laid depending on site conditions or on the situation. Since the front end of the band type fiber reinforcement material inserted into the reinforcement material insertion member, provided in the facing member, is folded in the longitudinal direction, and is maintained in tight contact with the inner surface of the reinforcement material insertion member, no additional pulling operation is needed. In addition, when the reinforced soil mass sinks after construction, the front end of the band type fiber reinforcement material slides vertically without being damaged, whereby it is possible to prevent shear stress from being concentrated on the connection between the front end of the band type fiber reinforcement material and the facing member. Furthermore, swelling or twisting of the facing member does not occur, whereby it is possible to construct a reinforced soil retaining wall that exhibits high stability.

BRIEF DESCRIPTION OF THE DRAWINGS

FIG. 1 is a rear perspective view of a retaining wall, including an enlarged view of the main parts of the retaining wall, showing a method of constructing band type fiber reinforcement materials according to a first embodiment of the present invention;

FIG. 2 is a plan view showing the state of FIG. 1;

FIG. 3 is an enlarged view showing part A of FIG. 2;

FIG. 4 is a perspective view showing a process of folding the front end of a band type fiber reinforcement material so as to have a half width and tightly attaching the front end of a band type fiber reinforcement material to a reinforcement material insertion member;

FIG. 5 is a side sectional view showing the state in which the band type fiber reinforcement material, which is folded so as to have a half width, slides when a reinforced soil mass sinks after the retaining wall is constructed;

FIG. 6 is a perspective view showing a method of constructing a band type fiber reinforcement material according to a second embodiment of the present invention;

FIG. 7 is an enlarged view showing part B of FIG. 6;

FIG. 8 is a plan view showing the state of FIG. 6;

FIG. 9 is a perspective view showing the state in which the front end of the band type fiber reinforcement material is folded so as to have a half width, the middle part of the band type fiber reinforcement material is laid flat on a filling mass in a serpentine fashion, and the rear end of the band type fiber reinforcement material is disposed in a standing fashion so as to be in a loop shape in order to bury the band type fiber reinforcement material in a backfill material;

FIG. 10 is a perspective view showing a reinforcement material insertion member according to an embodiment of the present invention;

FIG. 11 is a plan sectional view of the reinforcement material insertion member according to the embodiment of the present invention;

FIG. 12 is a view showing the state in which guide rollers are installed in the reinforcement material insertion member and a band type fiber reinforcement material is inserted into the reinforcement material insertion member;

FIG. 13 is a perspective view showing a method of constructing a band type fiber reinforcement material according to a third embodiment of the present invention;

FIG. 14 is a plan view showing the state of FIG. 13;

FIG. 15 is a perspective view showing a reinforcement material insertion member according to another embodiment of the present invention;

FIG. 16 is a perspective view showing a method of constructing band type fiber reinforcement materials according to a fourth embodiment of the present invention;

FIG. 17 is a perspective view showing a method of constructing band type fiber reinforcement materials according to a fifth embodiment of the present invention;

FIG. 18 is a perspective view showing a method of constructing band type fiber reinforcement materials according to a sixth embodiment of the present invention;

FIG. 19 is a sectional view of a retaining wall structure constructed using a combination of the construction methods shown in FIGS. 16 to 18; and FIG. 20 shows the state in which a relatively low retaining wall is constructed in a retaining wall structure corresponding to FIG. 19.

DETAILED DESCRIPTION

[Best Mode]

Hereinafter, the preferred embodiments of the present invention, which do not define the present invention, will be described in detail with reference to the accompanying drawings.

The element referred to using the term "reinforced soil mass" in the following description will also be referred to using the term "filling mass" or "backfill material" in order to appropriately describe a process of constructing a reinforced soil retaining wall. However, the terms used in the description of the present invention are provided merely to concretely describe the present invention, and therefore the scope of the present invention is not limited by the terms used in the description of the present invention.

First, a method of constructing band type fiber reinforcement materials will be described. FIGS. 1 to 5 show a method of constructing band type fiber reinforcement materials according to a first embodiment of the present invention. The construction method according to this embodiment includes a first step of inserting a band type fiber reinforcement material 30 into reinforcement material insertion members 20 provided in facing members 10 standing at a front of a reinforced soil mass G such that the facing members 10 are adjacent to each other in leftward and rightward directions;

a second step of spreading the band type fiber reinforcement material 30 on the reinforced soil mass and laying and hardening a backfill material on the band type fiber reinforcement material 30 and the reinforced soil mass, and a third step of repeatedly carrying out the first step and the second step until a predetermined height is reached.

Each of the reinforcement material insertion members 20 includes two entrances 21 and 22, which are open to the rear surface 12 of a corresponding one of the facing members 10 and are spaced apart from each other in the leftward and rightward directions, and a through channel 23 formed inside the rear surface 12 of the facing member 10 between the two entrances 21 and 22, which are spaced apart from each other in the leftward and rightward directions. At the first step, the band type fiber reinforcement materials 30 are inserted into the reinforcement material insertion members 20, which are formed in the respective facing members 10, the front ends of the band type fiber reinforcement materials 30, which are withdrawn outside the entrances 21 or 22 of the reinforcement material insertion members 20, are folded in the longitudinal direction, and the front ends of the band type fiber reinforcement materials 30, which are folded in the longitudinal direction, are inserted into the reinforcement material insertion members 20 such that the front ends of the band type fiber reinforcement materials 30 are in tight contact with inner surfaces 21*a* and 22*a* of the reinforcement material insertion members 20. The band type fiber reinforcement materials 30 are cut to a predetermined length in consideration of the length to be constructed, and are individually connected to respective reinforcement material insertion members. The opposite ends of the band type fiber reinforcement materials 30 connected to the reinforcement material insertion members 20 are laid down on the reinforced soil mass so as to be spread toward the rear of the reinforced soil mass.

In this embodiment, the band type fiber reinforcement materials 30 are described and shown as being connected to the reinforcement material insertion members in the state of being spread so as to have a full width. However, the present invention is not limited thereto. The band type fiber reinforcement materials 30 may be inserted into the reinforcement material insertion members in the state of first being folded in the longitudinal direction. After being connected to the facing members 10, the band type fiber reinforcement materials are laid down so as to be spread on the reinforced soil mass.

In the drawings of this embodiment, each of the facing members 10 is shown as being formed in the shape of a panel. In addition to the panel shape shown in the drawings, however, the method of constructing band type fiber reinforcement materials according to the present invention may be applied to facing members, each of which is formed in the shape of a block. Consequently, the facing members should be interpreted as including both panel type members and block type members.

In addition, each of the panel type facing members 10 may be formed in various shapes, such as a cross shape, a T shape, and a hexagonal shape, in addition to a simple rectangular shape.

In addition, each of the facing members 10 is not limited to a concrete member. Of course, each of the facing members 10 may be entirely or partially made of a synthetic resin or a metal material.

In this embodiment, however, each of the facing members 10 is made of a concrete material, and therefore concrete is poured into a mold in the state in which the reinforcement material insertion members 20, each of which is made of a synthetic resin material or a non-concrete material, are placed in the mold at the time of forming each of the facing members 10, whereby each of the facing members 10 is formed. Even in the case in which each of the facing members is entirely or partially made of a synthetic resin, the reinforcement material insertion members 20 may be integrally formed with each of the facing members 10 using an appropriate mold, in the same manner as the case in which each of the facing members is made of a concrete material.

Reference numeral 42 indicates fixing pins (or fixing nails) for maintaining the state in which the band type fiber reinforcement materials 30, which are inserted into the reinforcement material insertion members 20, are folded in the longitudinal direction (the band type fiber reinforcement materials being shown as being folded so as to have a half width in the drawings).

In addition, in this embodiment, each of the reinforcement material insertion members 20 is formed in an approximate C shape. Each of the reinforcement material insertion members may be manufactured so as to have various dimensions depending on the dimension (e.g. width or thickness) of a corresponding one of the band type fiber reinforcement materials 30. In addition to the basic shape of the entrances 21 and 22 and the inner through channel 23 of each of the reinforcement material insertion members, the other parts of each of the reinforcement material insertion members may be manufactured so as to have various shapes.

In this embodiment, the outsides of the two entrances 21 and 22, which are spaced apart from each other in the leftward and rightward directions, are open to the rear surface 12 of each of the facing members 10 in the state of being extended in the leftward direction or the rightward direction such that a corresponding one of the band type fiber reinforcement materials 30 is inserted through one of the entrances 21 or 22 and is withdrawn through the other entrance 22 or 21, whereby easy connection of the band type fiber reinforcement materials to the reinforcement material insertion members is achieved.

In addition, in this embodiment, the vertical width of the entrances 21 and 22 and the through channel 23 of each of the reinforcement material insertion members 20 is greater than the width of a corresponding one of the band type fiber reinforcement materials 30. In the case in which the reinforced soil mass G sinks (see an arrow a1) in the state in which the band type fiber reinforcement material 30, which is inserted into the reinforcement material insertion member 20, is connected to the reinforcement material insertion member 20 in the state in which the band type fiber reinforcement material 30 is folded so as to have a half width in the longitudinal direction, as shown in a side sectional view of FIG. 5, the front end of the band type fiber reinforcement material 30, which is folded so as to have a half width, slides downward in the reinforcement material insertion member 20 (see an arrow a2) at the same time, whereby it is possible to prevent the occurrence of a phenomenon in which shear stress is concentrated on the front end of the band type fiber reinforcement material 30 due to sinking of the reinforced soil mass G, and therefore it is possible to provide a retaining wall that exhibits high stability.

As can be seen from the constructed state shown in FIGS. 1 to 3, in this embodiment, the facing members 10, which are adjacent to each other in the leftward and rightward directions, are disposed so as to have different heights such that steps are formed by the facing members. The reinforcement material insertion members 20 are disposed in two lines at the upper and lower sides of the rear surface 12 of each of the facing members 10. Before a backfill material is filled up to the same height as the adjacent facing members 10, the band type fiber reinforcement materials 30 are connected to the facing members 10, and the band type fiber reinforcement materials 30 are laid on the reinforced soil mass G. A single band type fiber reinforcement material 30 is cut to a predetermined length in consideration of the forward and rearward filling width of the backfill material, i.e. length that the band type fiber reinforcement materials are laid. The cut band type fiber reinforcement materials 30 are individually connected to the respective reinforcement material insertion members 20, and then the opposite ends of the band type fiber reinforcement materials, which are connected to the respective reinforcement material insertion members 20, are sequentially spread on the reinforced soil mass G toward the rear of the reinforced soil mass. Afterwards, the backfill material is laid and hardened on the band type fiber reinforcement materials 30 in order to support the facing members 10. The above processes may be sequentially repeated to construct a reinforced soil retaining wall structure having a designed height.

In this embodiment, a preferred method of folding the front end of a band type fiber reinforcement material 30 in the longitudinal direction (so as to have a half width in the figure) and tightly attaching the folded front end of the band type fiber reinforcement material 30 to a reinforcement material insertion member 20 is shown in FIG. 4, a description of which will follow.

First, as shown in FIG. 4(*a*), the band type fiber reinforcement material 30 is inserted through one of the entrances 21 or 22 of the reinforcement material insertion member 20, and is withdrawn through the other entrance 22 or 21 of the reinforcement material insertion member 20.

Second, as shown in FIG. 4(*b*), the front end of the band type fiber reinforcement material 30, which is withdrawn outside the entrance 21 or 22 of the reinforcement material insertion member 20, is folded so as to have a half width.

Third, as shown in FIG. 4(*c*), the front end of the band type fiber reinforcement material 30, which is folded so as to have a half width, is inserted again into the reinforcement material insertion member 20.

Fourth, as shown in FIG. 4(*d*), the portions of the band type fiber reinforcement material 30 folded so as to have a half width are exposed in a symmetrical fashion outside the entrances 21 and 22 of the reinforcement material insertion member 20 in the state in which the front end of the band type fiber reinforcement material 30 is folded so as to have a half width.

In the above embodiment, the front end of each of the band type fiber reinforcement materials 30 is folded so as to have a half width. However, the present invention is not limited thereto. The front end of each of the band type fiber reinforcement materials 30 may be folded several times so as to have a ⅓ width, a ¼ width, or a smaller width in the longitudinal direction, in addition to a half width. In addition, each of the band type fiber reinforcement material 30 may be folded at one of the entrances 21 and 22 of a corresponding one of the reinforcement material insertion members 20 or both the entrances 21 and 22 of a corresponding one of the reinforcement material insertion members 20.

In addition, in this embodiment, the method of connecting the band type fiber reinforcement materials 30 to the reinforcement material insertion members 20, each of which is made of a synthetic resin and which are laid in the respective facing members 10, is described. However, the present invention is not limited thereto. The present invention may also be applied to a method of connecting the band type fiber reinforcement materials 30 to C-shaped reinforcement material insertion members formed in the respective facing members 10. The scope of the present invention should be interpreted as including both the above methods.

In the method of constructing the band type fiber reinforcement materials according to the present invention, the band type fiber reinforcement material 30 is in tight contact with the reinforcement material insertion member 20 in the state of being folded in the longitudinal direction, and the state in which the band type fiber reinforcement material 30 is in tight contact with the inner surface of the through channel 23 of the reinforcement material insertion member 20 is maintained through interaction between the force by which the portions folded by the fixing pins 42 will be separated from each other and the portions that will be spread so as to have a full width, as can be seen from an enlarged view of FIG. 3. As a result, the band type fiber reinforcement material 30 is prevented from being pushed to the front of the through channel 23.

In the present invention, wedges may be inserted into the entrances 21 and 22 of each of the reinforcement material insertion members 20 in order to prevent the band type fiber reinforcement materials from being unfolded or moving, in addition to the fixing pins 42. In this case, no additional pulling operation is needed after the band type fiber reinforcement materials are laid on the reinforced soil mass G.

In addition, in this embodiment, the state in which the band type fiber reinforcement materials 30 are laid while being spread flat on the reinforced soil mass G may be stably maintained using temporary fixing nails (not shown), whereby it is possible to easily perform a process of laying and hardening the backfill material.

In addition, in this embodiment, the band type fiber reinforcement materials 30, which are spread on the reinforced soil mass G, are constructed so as to be at an angle with respect to the facing members 10, as shown in the figures. However, the present invention is not limited thereto. The band type fiber reinforcement materials may be disposed so as to be perpendicular to the facing members, or may be constructed such that adjacent band type fiber reinforcement materials intersect each other. The band type fiber reinforcement materials may be constructed in various manners depending on site conditions.

In addition, in this embodiment, separate manual resistance bodies may be attached to the middle parts or the rear ends of the band type fiber reinforcement materials 30, which are spread on the reinforced soil mass G, in order to provide additional manual resistance force in addition to the frictional resistance to the backfill material in the case in which the backfill width of the retaining wall is narrow, i.e. in a site in which the length of the reinforcement materials to be constructed in the forward and rearward directions is short. The manual resistance bodies may be made of various materials, such as concrete, a synthetic resin, and a metal material.

FIGS. 6 to 9 show a reinforced soil retaining wall structure and a method of constructing a band type fiber reinforcement material according to a second embodiment of the present invention. The reinforced soil retaining wall structure according to this embodiment includes facing members 10, in which reinforcement material insertion members 20 are laid, and a band type fiber reinforcement material 30, which is inserted into reinforcement material insertion members 20 provided in the facing members 10 and which is buried in the state of being laid on a reinforced soil mass (i.e. a filling mass) G.

The method of constructing the band type fiber reinforcement material according to this embodiment is basically identical to the construction method according to the first embodiment except that, at the first step, the band type fiber reinforcement material 30 is successively inserted into the reinforcement material insertion members 20, which are adjacent to each other in the leftward and rightward directions, and at the second step, the band type fiber reinforcement material 30 is pulled from each of the reinforcement material insertion members 20 in a rearward direction such that the band type fiber reinforcement material 30 is laid on the reinforced soil mass G in a serpentine fashion, a middle part 34 of the band type fiber reinforcement material 30, which is laid on the reinforced soil mass G, is disposed on the reinforced soil mass G in a state of being spread so as to have a full width, and a rear end 36 of the band type fiber reinforcement material 30 is disposed in a loop shape.

In this embodiment, the method of folding the front end of the band type fiber reinforcement material 30 in the longitudinal direction and tightly attaching the folded front end of the band type fiber reinforcement material 30 to the inner surface of the reinforcement material insertion members 20 is performed as follows, in the same manner as in the construction method according to the first embodiment. The front ends of the band type fiber reinforcement materials 30, which are withdrawn outside the entrances 21 or 22 of the reinforcement material insertion members 20, are folded in the longitudinal direction, the front ends of the band type fiber reinforcement materials 30, which are folded in the longitudinal direction, are inserted into the reinforcement material insertion members 20, the front ends 32 of the band type fiber reinforcement materials 30 are folded in the longitudinal direction such that the front ends of the band type fiber reinforcement materials 30 are folded inside the reinforcement material insertion members 20 in the longitudinal direction, and the front ends of the band type fiber reinforcement materials 30 are brought into tight contact with the reinforcement material insertion members 20.

Even in this embodiment, the band type fiber reinforcement material 30 is described and shown as being connected to each of the reinforcement material insertion members in the state of being spread so as to have a full width. However, the present invention is not limited thereto. The band type fiber reinforcement material 30 may be inserted into each of the reinforcement material insertion members in the state of first being folded in the longitudinal direction. After being connected to the facing members 10, the band type fiber reinforcement material is laid down so as to be spread on the reinforced soil mass.

FIGS. 10 and 11 show a reinforcement material insertion member 20 that is installed in a facing member according to an embodiment of the present invention. The reinforcement material insertion member 20 includes two entrances 21 and 22, which are open to the rear surface 12 of the facing member 10 and spaced apart from each other in the leftward and rightward directions, and a through channel 23 formed inside the rear surface of the facing member 10 between the two entrances 21 and 22. Inner surfaces 21*a* and 22*a* of the entrances 21 and 22 are open so as to form a predetermined angle with respect to the rear surface 12 of the facing member 10. Outer surfaces 21*b* and 22*b* of the entrances 21 and 22 are open to the rear surface 12 of the facing member 10 such that the front sides of the outer surfaces 21*b* and 22*b* of the entrances 21 and 22 are wide and the rear sides of the outer surfaces 21*b* and 22*b* of the entrances 21 and 22 are narrow, whereby a flexible band type fiber reinforcement material 30 is easily inserted through one of the entrances 21 or 22 in a standing state and is easily withdrawn through the other entrance 22 or 21.

In this embodiment, the inner surfaces 21*a* and 22*a* of the entrances 21 and 22 are open so as to form a predetermined angle with respect to the rear surface 12 of the facing member 10 such that, when the band type fiber reinforcement material 30 is laid on the reinforced soil mass G in the rearward direction in the state in which the band type fiber reinforcement material 30 is inserted into the reinforcement material insertion member 20, as described above, the band type fiber reinforcement material 30 can be laid in the state of being perpendicular to the rear surface 12 of the facing member 10 or the band type fiber reinforcement material 30 can be laid in a serpentine fashion at an angle slightly greater than a right angle. The inner surfaces 21*a* and 22*a* are portions with which the front end of the band type fiber reinforcement material 30 is in contact in the state in which the band type fiber reinforcement material 30 is laid on the reinforced soil mass G. Consequently, the radius of curvature defined by the inner surface 23*a* of the through channel 23 formed between the inner surfaces 21*a* and 22*a* may be as large as possible so as to prevent the band type fiber reinforcement material 30 from being abruptly bent.

The reinforcement material insertion member 20 of the embodiment shown in FIGS. 10 and 11 may be made of a polyethylene, polypropylene, or polyvinyl-based synthetic resin material, and therefore the reinforcement material insertion member may be mass-produced. Concrete mortar is poured into a mold for forming the facing member in the state in which the reinforcement material insertion member 20 is fixed in the mold such that the reinforcement material insertion member 20 is integrally formed with the facing member 10. Furthermore, the band type fiber reinforcement material, which is coated with the synthetic resin, is prevented from directing contacting concrete, whereby it is possible to prevent the occurrence of a phenomenon in which the physical properties of the band type fiber reinforcement material are changed due to a chemical reaction between the band type fiber reinforcement material and concrete.

In addition, the outer surface of the reinforcement material insertion member 20, i.e. the surface of the reinforcement material insertion member 20 that contacts the facing member, i.e. concrete, is somewhat rough, and the inner surface of the reinforcement material insertion member 20, i.e. the surface of the reinforcement material insertion member 20 through which the band type fiber reinforcement material is inserted, is somewhat smooth. Consequently, it is possible to increase the coupling force between the reinforcement material insertion member and the facing member and to achieve smooth insertion of the band type fiber reinforcement material through the reinforcement material insertion member. In addition, when the reinforced soil mass sinks, the band type fiber reinforcement material may effectively slide without damaging the surface of the front end of the band type fiber reinforcement material.

In addition, in the present invention, the reinforcement material insertion member 20 may be manufactured so as to have various dimensions depending on the dimension of the band type fiber reinforcement material 30. In addition to the basic shape of the entrances 21 and 22 and the inner through channel 23 of the reinforcement material insertion member, the other parts of the reinforcement material insertion member may be manufactured so as to have various shapes, a description of which will follow.

In addition, in the present invention, the reinforcement material insertion member 20 may be formed in the shape of an integral tube (e.g. a U-shaped tube), as shown in the figures. Alternatively, the reinforcement material insertion member 20 may be divided into upper and lower parts or into front and rear parts, which may be assembled to each other to constitute the reinforcement material insertion member.

The reinforcement material insertion member 20 may be produced using a well-known injection molding method or a well-known blow molding method in consideration of the manufacturing cost thereof.

Meanwhile, in this embodiment, holes 24 for fixing the reinforcement material insertion member 20 to the mold for forming the facing member are formed around the entrances 21 and 22 of the reinforcement material insertion member 20 so as to be arranged in the horizontal direction and/or the vertical direction. The inner surfaces 21*a* and 22*a* and the upper and lower surfaces 21*c*, 21*d*, 22*c*, and 22*d*, in which the holes 24 are formed, protrude slightly outward from the rear surface 12 of the facing member 10.

The reinforcement material insertion member 20 is disposed in the mold, and then fixing pins, which can be separated from a support body (e.g. a bracket or section steel) for supporting the reinforcement material insertion member 20, are inserted through the holes 24 from outside in order to fix the reinforcement material insertion member.

In addition, guide rollers (see FIG. 12) for assisting the insertion and withdrawal of the band type fiber reinforcement material when the reinforced soil retaining wall is constructed may be inserted through the holes 24, or shape maintenance pins 42 (see FIG. 9) for maintaining the state in which the band type fiber reinforcement material is folded in the longitudinal direction may be inserted through the holes 24.

In addition, the outer surfaces 21*b* and 22*b* of the entrances 21 and 22 extend so as to have the same planar state as the rear surface 12 of the facing member 10. At the time of forming the facing member 10, the outer surfaces 21*b* and 22*b* serve as support surfaces or reference surfaces for enabling the reinforcement material insertion member 20 to be maintained in the same planar orientation as the rear surface 12 of the facing member 10.

In addition, in this embodiment, the vertical width of the entrances 21 and 22 and the through channel 23 of the reinforcement material insertion member 20 is greater than the width of the band type fiber reinforcement material 30. In the case in which the reinforced soil mass G sinks in the state in which the band type fiber reinforcement material 30, which is inserted into the reinforcement material insertion member 20, is connected to the reinforcement material insertion member 20 in the state in which the band type fiber reinforcement material 30 is folded in the lateral direction, as shown in the sectional view of FIG. 5, the band type fiber reinforcement material 30, which is buried in the reinforced soil mass G, sinks, and the front end 32 of the band type fiber reinforcement material 30 slides downward in the reinforcement material insertion member 20 at the same time, whereby it is possible to prevent the occurrence of a phenomenon in which shear stress is concentrated on the front end of the band type fiber reinforcement material 30 due to sinking of the reinforced soil mass G.

In the embodiment shown in FIGS. 6 to 9, each of the facing members 10 is formed in the shape of a panel. As shown in FIGS. 6 and 8, which show initially constructed states, the facing members 10, which are adjacent to each other in the leftward and rightward directions, are disposed so as to have different heights such that steps are formed by the facing members. The reinforcement material insertion members 20 are disposed in two lines at the upper and lower sides of the rear surface 12 of each of the facing members 10. Consequently, a single piece of band type fiber reinforcement material 30 can be successively connected to adjacent facing members 10. As a result, instead of cutting the band type fiber reinforcement material 30 to a predetermined length and individually connecting the cut band type fiber reinforcement materials 30 to the reinforcement material insertion members 20 of the facing members 10, the front end of a band type fiber reinforcement material, supplied in a rolled state, is successively inserted into the reinforcement material insertion members 20, which are located at the rear surface of the facing members 1, in a quilted fashion in the state in which the band type fiber reinforcement material stands upright. Subsequently, as shown in FIG. 9, the band type fiber reinforcement material 30 is pulled from the reinforcement material insertion members 20 in the rearward direction such that the band type fiber reinforcement material 30 is laid on the reinforced soil mass G in a serpentine fashion so as to fit the width of the reinforced soil mass G in the forward and rearward directions, the front end 32 of the band type fiber reinforcement material 30 is folded so as to have a half width such that the front end 32 of the band type fiber reinforcement material 30 is in tight contact with each of the reinforcement material insertion members 20, the middle part 34 of the band type fiber reinforcement material 30 is laid on the reinforced soil mass G in the state of being spread so as to have a full width, and the rear end 36 of the band type fiber reinforcement material 30 is disposed in a standing fashion so as to be in a loop shape. Subsequently, a backfill material is laid on the reinforced soil mass in order to support the facing members 10. The above processes may be sequentially repeated to construct a reinforced soil retaining wall structure having a designed height.

In this embodiment, the method of folding the front end 32 of the band type fiber reinforcement material 30 in the longitudinal direction (so as to have a half width in the figure) and tightly attaching the folded front end of the band type fiber reinforcement material 30 to each of the reinforcement material insertion members 20 is identical to the method in the first embodiment described above, and therefore a duplicate description thereof will be omitted.

In the present invention, successive insertion of the band type fiber reinforcement material 30 through the reinforcement material insertion members 20 means that a single band type fiber reinforcement material 30 is inserted into two or more reinforcement material insertion members 20. The number of reinforcement material insertion members 20 that are successively connected and the number of facing members 10 that are successively connected may be changed depending on the circumstances.

In addition, in this embodiment, the method of successively connecting the band type fiber reinforcement material 30 to the reinforcement material insertion members 20, each of which is made of a synthetic resin and which are laid in the respective facing members 10, is described. However, the present invention is not limited thereto. The present invention may also be applied to a method of successively connecting the band type fiber reinforcement material 30 to U-shaped reinforcement material insertion members formed in the respective facing members 10. The scope of the present invention should be interpreted as including both the above methods.

In this embodiment, the rear end 36 of the band type fiber reinforcement material 30 may be disposed in a standing fashion so as to be in a loop shape, as described above. Of course, a reinforcing bar may be inserted into the rear end 36 such that the reinforcing bar is horizontally flat in the loop shape, and a backfill material may be laid, in the same manner as in a method that is used when a general band type fiber reinforcement material is constructed.

In the present invention, the band type fiber reinforcement material 30 may be inserted into the reinforcement material insertion members 20 of the facing members 10 in a quilted fashion, as shown in FIG. 6, and then the band type fiber reinforcement material 30 may be pulled to the rear of the reinforced soil mass. Alternatively, the band type fiber reinforcement material 30 may be inserted into one reinforcement material insertion member, may be pulled to the rear of the reinforced soil mass such that the band type fiber reinforcement material is laid on the reinforced soil mass, and may be inserted into another adjacent reinforcement material insertion member, which may be repeated to construct the band type fiber reinforcement material.

In this embodiment, the shapes of the front end 32, the middle part 34, and the rear end 36 of the band type fiber reinforcement material 30 may be maintained using separate shape maintenance members (e.g. temporary fixing pins or nails or manual resistance bodies), which are not shown in the figures. The shape maintenance members may be buried in the reinforced soil mass G.

FIG. 12 shows the state in which guide rollers 40 are installed in the entrances 21 and 22 of the reinforcement material insertion member 20 in order to make it easier to connect the band type fiber reinforcement material to the reinforcement material insertion member at the time of constructing the reinforced soil retaining wall structure according to this embodiment. The guide rollers 40 function to prevent direct friction between the band type fiber reinforcement material 30 and the reinforcement material insertion member 20 such that the band type fiber reinforcement material 30 can be withdrawn smoothly in the process of successively fastening the band type fiber reinforcement material 30 to the reinforcement material insertion member 20 of the facing member 10 in the leftward and rightward directions and in the process of withdrawing the band type fiber reinforcement material 30 to the rear of the reinforced soil mass after the fastening process. The guide rollers 40 may be removed and reused in subsequent processes after the installation of the band type fiber reinforcement material 30.

Meanwhile, in this embodiment, the reinforcement material insertion members 20 are disposed in two lines at the upper and lower sides of the rear surface 12 of each of the facing members 10. However, the present invention is not limited thereto. The reinforcement material insertion members 20 may be disposed in two or more lines at the upper and lower sides of the rear surface 12 of each of the facing members 10. Alternatively, the reinforcement material insertion members 20 may be disposed in one line at the middle part of the rear surface 12 of each of the facing members 10. Particularly, in the case in which each of the facing members is a block type facing member having a small vertical width, it is preferable for the reinforcement material insertion members to be disposed in one line at the middle part of the rear surface of the facing member.

In addition, in this embodiment, a pair of reinforcement material insertion members is laid in each of the left and right sides of the rear surface of each of the facing members 10. However, the present invention is not limited thereto. The reinforcement material insertion members may be disposed in various manners as follows. For example, a pair of reinforcement material insertion members may be laid in the middle part of the rear surface of each of the facing members. Alternatively, a reinforcement material insertion member may be laid in each of the left and right sides of the rear surface of each of the facing members. Alternatively, the width of each of the facing members 10 may be increased, and a plurality of reinforcement material insertion members may be laid in the rear surface of each of the facing members 10.

FIGS. 13 and 14 show a method of constructing a reinforced soil retaining wall structure according to a third embodiment of the present invention, i.e. a method of connecting a band type fiber reinforcement material that is somewhat different from the method according to the second embodiment. Even in this embodiment, facing members 10, which are adjacent to each other in the leftward and rightward directions, are disposed so as to have different heights such that steps are formed by the facing members, a single piece of band type fiber reinforcement material 30 is successively connected to reinforcement material insertion members 20 provided in the rear surface 12 of each of the facing members 10, and the band type fiber reinforcement material 30 is pulled from the reinforcement material insertion members 20 in the rearward direction such that the band type fiber reinforcement material 30 is laid on the reinforced soil mass G so as to fit the width of the reinforced soil mass G in the forward and rearward directions, basically in the same manner as in the second embodiment. However, this embodiment is different from the second embodiment in that the band type fiber reinforcement material 30 is intermittently laid on the reinforced soil mass such that the portion of the band type fiber reinforcement material that is inserted into each of the reinforcement material insertion members 20 is in tight contact with the rear surface 12 of a corresponding one of the facing members 10.

In this embodiment, the front end 32 of the band type fiber reinforcement material 30 extending toward the reinforced soil mass G is in tight contact with each of the reinforcement material insertion members 20 in the state of being folded so as to have a half width, and the portion of the band type fiber reinforcement material 30 that is in tight contact with the rear surface 12 of each of the facing members 10 without being laid on the reinforced soil mass stands upright so as to have a full width. In addition, the middle part 34 of the band type fiber reinforcement material 30 is laid on the reinforced soil mass G in the state of being spread so as to have a full width, and the rear end 36 of the band type fiber reinforcement material 30 is disposed in a standing fashion so as to be in a loop shape. Subsequently, a backfill material is laid on the reinforced soil mass in order to support the facing members 10. The above processes may be sequentially repeated to construct a reinforced soil retaining wall structure having a designed height.

The construction method according to this embodiment is appropriately used in the case in which space is necessary when various structures are installed in the backfill material, in the case in which rock bolts are connected to nails of a cut slope, in the case in which a reinforced soil retaining wall having a lower height than the reinforced soil retaining wall constructed using the construction method according to the first embodiment is constructed, or in the case in which the upper part of the reinforced soil retaining wall is constructed. The band type fiber reinforcement material may be laid densely or intermittently in consideration of construction site conditions or economy. Successive construction of the band type fiber reinforcement material has the effects of improving site applicability and workability and increasing construction speed, compared to a conventional individual construction method. In addition, the band type fiber reinforcement material may also function to interlock facing members that are adjacent to each other in the leftward and rightward directions, whereby it is possible to improve workability and construction efficiency and to improve the safety of the reinforced soil retaining wall structure after the construction.

FIG. 15 shows a reinforcement material insertion member 20 according to another embodiment of the present invention. Even in this embodiment, the reinforcement material insertion member fundamentally includes two entrances 21 and 22 and a through channel 23 interconnecting the entrances 21 and 22. However, the reinforcement material insertion member according to this embodiment is different from the reinforcement material insertion member according to the first embodiment in that an insertion groove 25, into which a band type fiber reinforcement material is inserted in the state of being folded so as to have a half width, is formed in the inside of the through channel 23 and in that support ribs 26 are provided at the edges of the entrances 21 and 22 so as to protrude outward.

The reinforcement material insertion member 20 according to this embodiment is laid in the facing members and used in the same manner as in the reinforcement material insertion member according to the first embodiment, and therefore a duplicate description thereof will be omitted. However, the structure of the reinforcement material insertion member 20 according to the present invention is not limited to the above-described embodiment. It is obvious that the reinforcement material insertion member can be variously modified by those skilled in the art to which the present invention pertains without departing from the concept of the invention recited in the claims and that such modifications fall within the scope of the present invention.

FIG. 16 shows a method of constructing band type fiber reinforcement materials according to a fourth embodiment of the present invention. In this embodiment, in the case in which it is not possible to sufficiently provide the backfill length of a reinforced soil mass G at the rear of facing members 10, i.e. in the case in which a rock bed or a concrete structure is adjacent to the rear of the facing members 10, mesh bags 50 are installed at the rear of the facing members 10, the mesh bags 50 are filled with rock debris or other aggregate 60, and band type fiber reinforcement materials 30, the front ends of which are connected to the facing members 10, are put around the mesh bags 50 such that the facing members 10 and the mesh bags 50, which are filled with the aggregate 60, are integrally connected to each other by the band type fiber reinforcement materials 30, whereby support force (i.e. manual resistance force) is realized.

Even in this embodiment, the method of connecting the band type fiber reinforcement materials 30 to the facing members 10 is identical to the method according to the previous embodiment except that the band type fiber reinforcement materials 30 are placed around the mesh bags 50 in a standing fashion in the manner of placing a belt around pants in order to stably maintain the shape of the mesh bags 50 when the mesh bags 50 are filled with the aggregate 60, such as rock debris. After the mesh bags 50 are filled with the aggregate 60, the band type fiber reinforcement materials 30, which are put around the rock fill, which is constructed using gravity, securely support the facing members 10.

In this embodiment, a reinforced soil construction method, in which a band type fiber reinforcement material is laid and hardened in reinforced soil mass when constructing a lower layer part of a retaining wall in which it is not possible to sufficiently provide the backfill length of the reinforced soil mass (the width of the band type fiber reinforcement material that is laid in the forward and rearward directions) or when constructing a low retaining wall, and a kind of gravity type construction method (e.g. rock filling) are combined in order to improve constructability. In addition, the method according to this embodiment is a method that is appropriate for partial application to a site in which it is difficult to directly apply a reinforced soil retaining wall construction method (i.e. in the case in which it is not possible to provide a backfill space due to a rock bed or a concrete structure).

In addition, in the embodiment shown in FIG. 16, the band type fiber reinforcement materials 30 are successively connected to adjacent facing members 10 in a quilted fashion, and the mesh bags 50 are installed so as to contact the inside of the rear surface of each of the facing members 10. However, the present invention is not limited thereto. As in a fifth embodiment shown in FIG. 17, the mesh bags 50 may be installed at the rear of each of the connections between facing members 10 that are adjacent to each other in the leftward and rightward direction. In this case, water generated in the reinforced soil mass (i.e. the filling mass) may be easily discharged out of the front of the facing members 10 through the gaps between the adjacent facing members 10 via the aggregate 60 in the mesh bags 50.

In the present invention, the position and size of the mesh bags 50, which are supported by the band type fiber reinforcement materials 30, are not limited to the embodiments shown in FIGS. 16 and 17. The position and size of the mesh bags may be appropriately changed depending on the construction site conditions. Each of the mesh bags 50 may be made of various materials that are capable of being filled with rock fill, such as a mesh type wire net, a lath type wire net, a net type wire net, and a synthetic resin grid.

In addition, in the present invention, the height of each of the mesh bags 50, the length that each of the mesh bags 50 protrudes rearward, and the interval at which the mesh bags 50 are disposed in the leftward and rightward directions may be appropriately changed depending on the site conditions. The band type fiber reinforcement materials 30, which are connected to the rear of each of the facing members 10 in multiple stages, are put around the mesh bags 50 in multiple stages, whereby the shape of the mesh bags 50 may be stably maintained, and the facing members 10 and the aggregate (e.g. rock fill) 60, which are adjacent to each other in the upward and downward directions and in the leftward and rightward directions, may be integrated.

FIG. 18 shows a method of constructing band type fiber reinforcement materials according to a sixth embodiment of the present invention. In this embodiment, a method of laying band type fiber reinforcement materials 30 on a filling mass to achieve stability of the filling mass (i.e. a reinforced soil construction method) is combined with a method of disposing installing mesh bags 50, filling the mesh bags 50 with aggregate 60, and putting pieces of band type fiber reinforcement material around rock fill constructed using gravity to support facing members 10, as in the embodiments shown in FIGS. 16 and 17, at the same level.

The construction method shown in FIG. 18 is appropriately used in a transition region (e.g. a middle layer part), in which it is possible to construct the band type fiber reinforcement materials 30 but sufficient length cannot be provided, or in a region in which a rock bed or a concrete structure is locally located.

FIG. 19 is a sectional view of a retaining wall structure constructed using a combination of the construction methods shown in FIGS. 16 to 18. The construction method (i.e. the gravity type construction method) shown in FIGS. 16 and 17 is applied to the lower layer part of the retaining wall, the construction method (i.e. the compromise type construction method) shown in FIG. 18 is applied to the middle part of the retaining wall, and the construction method (i.e. the reinforced soil construction method) shown in FIGS. 6 and 9 is applied to the upper layer part of the retaining wall.

As can be seen from the figure, in this embodiment, in the case in which an obstacle, such as a rock bed or a concrete structure, is present in the retaining wall construction site, it is not necessary to crush the rock bed or to bore the rock bed in order to perform anchoring with respect to the rock bed. Consequently, it is possible to improve constructability and to reduce the construction time. The lower layer part of the retaining wall may be constructed using gravity through the use of a combination of mesh bags, which are inexpensive and can be easily acquired, rock debris, and band type fiber reinforcement materials. The middle part of the retaining wall may be constructed using a combination of a gravity type construction method and a reinforced soil retaining wall construction method, whereby it is possible to stably construct the filling mass and the facing members. The upper layer part of the retaining wall, in which it is possible to sufficiently provide the backfill length, may be constructed using a reinforced soil retaining wall construction method in which pieces of band type fiber reinforcement material are laid and buried.

FIG. 20 shows the state in which a relatively low retaining wall is constructed in a retaining wall structure corresponding to FIG. 19. Mesh bags 50, around which pieces of band type fiber reinforcement material 30 are put, are filled with aggregate 60, such as rock debris, and facing members 10 are integrated with the band type fiber reinforcement materials 30 and the rock fill in order to form a gravity type structure, which resists soil pressure from a soil layer and a backfill material located at the rear of the structure. This structure has the effects of improving the stability of the retaining wall structure, compared to a conventional gabion retaining wall or a counterforted wall, in which soil pressure is directly applied to a wall body (i.e. facing members).

In the above embodiments, the band type fiber reinforcement materials 30 are inserted into the reinforcement material insertion members 20, which are located at the rear of the facing members, in the state of being spread so as to have a full width. However, the present invention is not limited thereto. The band type fiber reinforcement materials may be inserted into the reinforcement material insertion members in the state of being folded so as to have a half width. In addition, the reinforcement materials may be folded or unfolded using appropriate methods at the time of inserting the reinforcement materials depending on the size or the shape of each of the reinforcement material insertion members.

DESCRIPTION OF REFERENCE SYMBOLS

10: Facing member (panel type or block type)
12: Rear surface
20: Reinforcement material insertion member
21, 22: Entrances
23: Through channel
21*a*, 22*a*: Inner surfaces
21*b*, 22*b*: Outer surfaces
21*c*, 22*c*: Upper surfaces
21*d*, 22*d*: Lower surfaces
24: Hole
25: Insertion groove
26: Support rib
30: Band type fiber reinforcement material
32: Front end (Half-width folded part)
34: Middle part (Unfolded part)
36: Rear end (Loop part)
40: Guide roller
42: Fixing pin
50: Mesh bag
60: Aggregate
G: Reinforced soil mass (Filling mass or backfill material)

The invention claimed is:

1. A method of constructing a band fiber reinforcement material for a reinforced soil retaining wall, the method comprising:

a first step of inserting a band fiber reinforcement material into reinforcement material insertion members provided in facing members standing at a front of a reinforced soil mass (G) such that the facing members are adjacent to each other in leftward and rightward directions;

a second step of spreading the band fiber reinforcement material on the reinforced soil mass and laying and hardening a backfill material on the band fiber reinforcement material and the reinforced soil mass; and a third step of repeatedly carrying out the first step and the second step until a predetermined height is reached, wherein each of the reinforcement material insertion members comprises two entrances, which are open to a rear surface of a corresponding one of the facing members and spaced apart from each other in the leftward and rightward directions, and a through channel formed inside the rear surface of the corresponding one of the facing members between the two entrances which are spaced apart from each other in the leftward and rightward directions, the through channel having a predetermined radius of curvature defined by an inner surface of the through channel, wherein the first step of inserting comprises inserting the band fiber reinforcement material through one of the entrances and withdrawing the band fiber reinforcement material through the other entrance in a state of being spread so as to have a full width, whereby the band fiber reinforcement material is connected to each of the reinforcement material insertion members, and further comprising the steps of folding in a longitudinal direction a front end of the band fiber reinforcement material, which is withdrawn outside the entrance of each of the reinforcement material insertion members, and inserting the front end of the band fiber reinforcement material, which is folded in the longitudinal direction, into each of the reinforcement material insertion members, such that the front end of the band fiber reinforcement material is folded.

2. The method according to claim 1, wherein at the first step, the band fiber reinforcement material is successively inserted into the reinforcement material insertion members, which are adjacent to each other in the leftward and rightward directions, and at the second step, the band fiber reinforcement material is pulled from each of the reinforcement material insertion members in a rearward direction such that the band fiber reinforcement material is laid on the reinforced soil mass (G) in a serpentine fashion, a middle part of the band fiber reinforcement material, which is laid on the reinforced soil mass (G), is disposed on the reinforced soil mass (G) in a state of being spread so as to have a full width, and a rear end of the band fiber reinforcement material is disposed in a loop shape.

3. The method according to claim 2, wherein, when the band fiber reinforcement material is successively inserted into the reinforcement material insertion members and when the band fiber reinforcement material is successively withdrawn from the reinforcement material insertion members, guide rollers are attached to the reinforcement material insertion members in order to achieve smooth insertion and withdrawal of the band fiber reinforcement material.

4. The method according to claim 2, wherein the band fiber reinforcement material is pulled from the reinforcement material insertion members in the rearward direction such that the band fiber reinforcement material is laid on the reinforced soil mass (G) so as to fit a width of the reinforced soil mass (G) in forward and rearward directions and wherein the band fiber reinforcement material is laid such that a portion of the band fiber reinforcement material, which is inserted into each of the reinforcement material insertion members, is in tight contact with the rear surface of a corresponding one of the facing members.

5. The method according to claim 1, wherein at the first step, the band fiber reinforcement material is cut to a predetermined length in consideration of a laying length thereof, and the cut band fiber reinforcement materials are individually connected to the respective reinforcement material insertion members, and at the second step, opposite ends of the band fiber reinforcement materials connected to the reinforcement material insertion members are laid down on the reinforced soil mass so as to be spread toward a rear of the reinforced soil mass.

6. The method according to claim 1, wherein the band fiber reinforcement material inserted into the reinforcement material insertion members is fixed by fixing pins or wedges in order to prevent the band fiber reinforcement material from being unfolded or moving.

* * * * *